US007195420B2

(12) United States Patent
Skalka

(10) Patent No.: US 7,195,420 B2
(45) Date of Patent: Mar. 27, 2007

(54) BOLLARD AND ACCESSORIES FOR USE THEREWITH

(75) Inventor: Gerald P. Skalka, Potomac, MD (US)

(73) Assignee: Secure Site Design, LLC, Potomac, MD (US)

( * ) Notice: Subject to any disclaimer, the term of this patent is extended or adjusted under 35 U.S.C. 154(b) by 0 days.

(21) Appl. No.: 11/335,528

(22) Filed: Jan. 20, 2006

(65) Prior Publication Data

US 2006/0133895 A1 Jun. 22, 2006

Related U.S. Application Data

(63) Continuation of application No. 11/063,777, filed on Mar. 18, 2005, and a continuation-in-part of application No. 29/213,521, filed on Sep. 20, 2004, now Pat. No. Des. 518,187, and a continuation-in-part of application No. 29/203,647, filed on Apr. 19, 2004, now Pat. No. Des. 507,358, and a continuation-in-part of application No. 10/252,538, filed on Sep. 24, 2002, which is a continuation-in-part of application No. 29/165,862, filed on Aug. 20, 2002, now Pat. No. Des. 474,846.

(51) Int. Cl.
*E01F 15/00* (2006.01)
*E01F 13/00* (2006.01)

(52) U.S. Cl. ..... 404/6; 404/9; 256/13.1

(58) Field of Classification Search ..... 404/6–10, 404/11; 116/63 R, 63 P, 63 C, 63 T; D25/126; 256/13.1; 49/49
See application file for complete search history.

(56) References Cited

U.S. PATENT DOCUMENTS

| | | | | |
|---|---|---|---|---|
| 2,001,646 | A | 5/1935 | Abitsch | |
| 2,441,309 | A | 5/1948 | Cook | |
| 3,081,054 | A | 3/1963 | Westervelt | |
| 3,521,596 | A | 7/1970 | Schlein | |
| 3,555,550 | A | 1/1971 | Walters | |
| 3,800,735 | A | 4/1974 | Simpson | |
| 3,875,720 | A | 4/1975 | Russell | |
| 4,003,161 | A * | 1/1977 | Collins | 49/35 |
| 4,036,293 | A | 7/1977 | Tank et al. | |
| 4,103,853 | A | 8/1978 | Bannan | |
| 4,187,785 | A | 2/1980 | Juh | |

(Continued)

FOREIGN PATENT DOCUMENTS

FR 2567855 A * 1/1986

*Primary Examiner*—Raymond W. Addie
(74) *Attorney, Agent, or Firm*—Jacobson Holman PLLC

(57) ABSTRACT

A bollard having a plurality of parallel, vertical legs spaced apart from each other on the perimeter of a regular geometric shape. The minimum number and/or cross-section of the legs is governed by the need to avoid creating an entrapment area between adjacent legs. If an even number of legs is provided, they can be arranged in diametrically opposite pairs of decreasing height, the pairs of legs being joined at their tops to form a series of at least three nested, inverted substantially U-shaped forms of decreasing height set around a common vertical axis. The bollard also includes elements for joining the legs together as a unit, for example, a cylindrical center member having the common vertical axis of the legs as its longitudinal axis, a longitudinal rib joining each leg to the center member, and a plurality of horizontal ribs joining adjacent legs to each other.

27 Claims, 23 Drawing Sheets

U.S. PATENT DOCUMENTS

| | | | | | |
|---|---|---|---|---|---|
| 4,197,807 | A | | 4/1980 | Campbell | |
| 4,349,293 | A | * | 9/1982 | Rosenberger | 404/41 |
| 4,686,144 | A | | 8/1987 | Hupfer et al. | |
| 4,858,382 | A | | 8/1989 | Ellgass | |
| 4,999,749 | A | * | 3/1991 | Dormand | 362/153.1 |
| D319,159 | S | | 8/1991 | Silbersky et al. | |
| D324,920 | S | | 3/1992 | Miller et al. | |
| 5,149,901 | A | | 9/1992 | Boor et al. | |
| 5,176,830 | A | | 1/1993 | Wiggins | |
| 5,305,705 | A | | 4/1994 | Gagliano | |
| 5,309,674 | A | * | 5/1994 | Weibel | 49/49 |
| D361,229 | S | | 8/1995 | Laske | |
| 5,438,937 | A | | 8/1995 | Ball et al. | |
| 5,566,638 | A | | 10/1996 | Rokosny | |
| 5,788,405 | A | | 8/1998 | Beard | |
| 5,829,913 | A | * | 11/1998 | Puckett | 404/6 |
| D406,664 | S | | 3/1999 | Müller | |
| 5,960,601 | A | | 10/1999 | Offutt | |
| D416,853 | S | * | 11/1999 | Aitken | D12/317 |
| 6,099,200 | A | * | 8/2000 | Pepe et al. | 404/6 |
| D447,250 | S | | 8/2001 | Dionne et al. | |
| 6,341,877 | B1 | | 1/2002 | Chong | |
| 6,375,385 | B1 | | 4/2002 | Kennedy | |
| 6,378,821 | B1 | | 4/2002 | McKelvy et al. | |
| 6,514,006 | B1 | * | 2/2003 | Hines | 404/9 |
| D474,846 | S | | 5/2003 | Skalka | |
| D507,358 | S | | 7/2005 | Skalka | |
| 6,945,730 | B1 | * | 9/2005 | Lobban | 404/9 |
| 6,997,638 | B2 | * | 2/2006 | Hensley et al. | 404/6 |
| 7,040,836 | B2 | * | 5/2006 | Rogers et al. | 404/6 |
| 7,052,201 | B2 | * | 5/2006 | Zivkovic | 404/11 |

* cited by examiner

A
10a
10
10b
20
14
10c
22
14
24
24
40
42
50

1E
10
10a
12
12
10b
10c
14
20
1E
24
1F
1F
40
40
50

12
20

42
40
12
10c
10b
12
10a 40
20
16
A
22
14
30
24
42

40
14
24
42
16
A
22
30
16
14

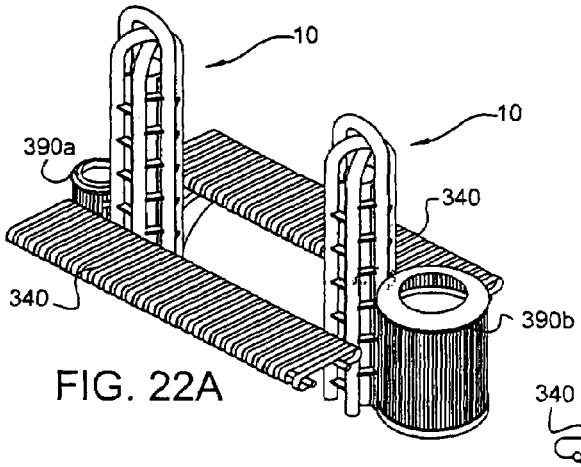
FIG. 22A
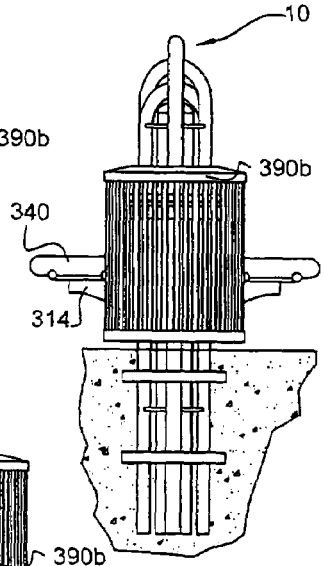
FIG. 22C
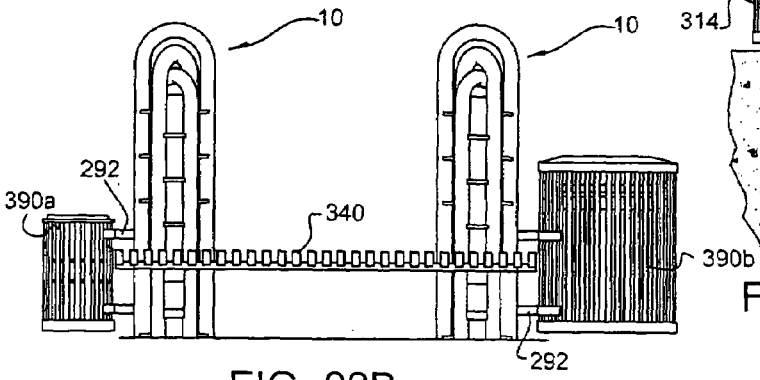
FIG. 22B
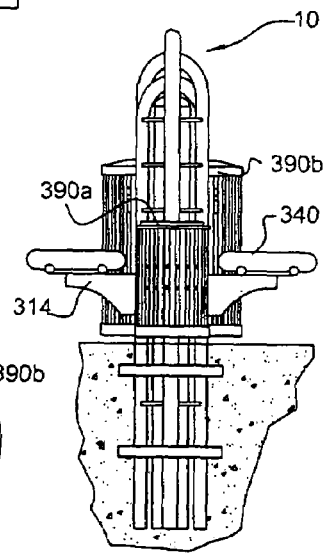
FIG. 22D
FIG. 22E
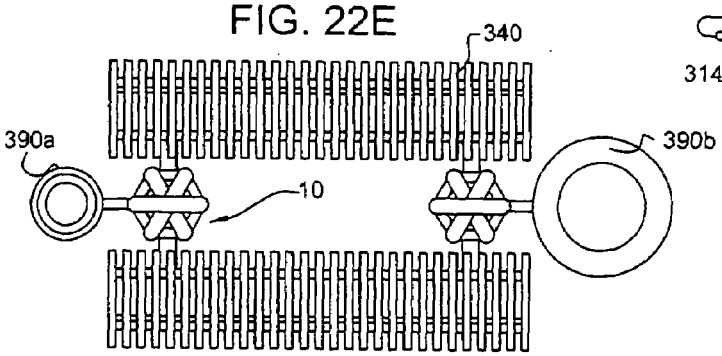

BOLLARD AND ACCESSORIES FOR USE THEREWITH

CROSS-REFERENCE TO RELATED APPLICATIONS

The present patent application is a continuation of application Ser. No. 11/063,777, filed Mar. 18, 2005, which is a continuation-in-part of application Ser. No. 29/165,862, filed Aug. 20, 2002, now U.S. Pat. No. D,474,846 a continuation-in-part of application Ser. No. 10/252,538, filed Sep. 24, 2002, a continuation-in-part of application Ser. No. 29/203,647, filed Apr. 19, 2004, U.S. Pat. No. D,507,358 and a continuation-in-part of application Ser. No. 29/213,521, filed Sep. 20, 2004, now U.S. Pat. No. D,518,187 all of which are incorporated herein by reference in their entireties.

BACKGROUND OF THE INVENTION

1. Field of the Invention

The present invention relates to bollards. More specifically, the invention relates to a bollard that is usable alone or in a system of bollards, and/or with site amenities including but not limited to seating, shelters, signage, lamps, ash-urns, and litter receptacles.

2. Related Art

As a result of the newly defined threat to people occupying ordinary public places in their daily activities, it has now become apparent that conventional bollards and site amenities (sometimes referred to as site furnishings or site furniture, and including, for example, benches and chairs, litter receptacles, lamps, etc.) must evolve into devices that enhance security, provide conventional function (for example, seating, litter control, lighting, shade, shelter, signage, etc.) and allow for the subtle directing of pedestrian traffic. They also must allow for a pleasing, cohesive design system that integrates multiple functions.

Such devices must also eventually meet standards now being written to accommodate the threats posed by vehicular traffic in or near pedestrian spaces. They must likewise provide reasonable barrier protection to entrances, plazas, city streets, areas of congestion, etc. They must simultaneously be cost effective and flexible in design to provide multiple functions. Their design must be easily modified to provide increased strength and protection without inordinately higher cost or significantly larger size, as larger size can easily overwhelm public spaces, making the function of providing protection a deterrent to the successful use of public spaces. Scale is important given the limited space available, the footprint of such devices, and the necessity for the safe movement of pedestrians.

In addition, as a standard requirement, bollards must be sufficiently attractive to provide permanent and otherwise successful replacement for the concrete slabs and "Jersey Walls" that have been placed temporarily to provide safety.

The same design bollard must be adaptable to accompany seating, shelters, signage, lamps, and the holding of such elements as ash-urns and litter receptacles. In all such configurations, the bollard must be easily installable as an in-ground structure. The bollard must be configurable to accommodate the evolving standards for the spacing of bollards and barriers, while meeting conventional requirements for accessibility for all people.

These diverse and constantly changing criteria make it necessary to design bollards as part of a set of safety, protective, informational, and convenience requirements.

It is to the solution of these and other problems that the present invention is directed.

SUMMARY OF THE INVENTION

It is accordingly a primary object of the present invention to provide a bollard that is cost effective and flexible in design.

It is another object of the present invention to provide a bollard that can be easily modified to provide increased strength and protection without inordinately higher cost or significantly larger size.

It is still another object of the present invention to provide a bollard that is adaptable to seating, shelters, bollards, signage, lighting, and the holding of such elements as ash-urns and litter receptacles.

It is still another object of the present invention to provide a bollard that is usable alone or in a grouping of other bollards, or with accessories including but not limited to seating, shelters, signage, lighting, ash-urns, and litter receptacles.

These and other objects of the invention are achieved by the provision of a bollard that can be used individually or in combination with other similar bollards. The bollard comprises a plurality of parallel, vertical legs spaced apart from each other on the perimeter of a regular geometric shape, such as a circle or rectangle, with the legs set around a vertical axis passing through the center of the regular geometric shape. An even or odd number of legs can be provided. The minimum number and/or cross-section of the legs is governed by the need to avoid creating an entrapment area between adjacent legs. As the diameter or width of the geometric shape increases, the number and/or cross-section of the legs has to increase to keep the spacing between adjacent legs small enough to avoid creating an entrapment area, for example, below 3½ inches.

If an even number of legs is provided, the legs can be arranged in diametrically opposite pairs of decreasing height, the pairs of legs optionally being joined at their tops to form a series of at least three nested, inverted substantially U-shaped forms of decreasing height set around a common vertical axis. The upper transverse portion can be curved, either symmetrically or asymmetrically, with a smooth transition to the legs, or it can be linear and joined to the legs at a miter joint.

In one aspect of the invention, the legs can be provided with reinforcing inserts.

In another aspect of the invention, the bollard further comprises means for joining the legs together as a unit, for example, a center post having the vertical axis passing through the regular geometric shape as its longitudinal axis, a radial web joining each leg to the center post, and a plurality of lateral crosspieces joining adjacent legs to each other. The lateral crosspieces can be at the same or alternating heights.

In still another aspect of the invention, the center post can be hollow and provided with a reinforcing insert, such as a tube or an I-beam, extending coaxially with and longitudinally therethrough.

In still another aspect of the invention, the bollard further comprises means for anchoring the forms within a support, for example, anchor rings attached to the legs at or adjacent their bottom for anchoring the bollard in a concrete footing.

In still another aspect of the invention, the bollard can be used in a site amenity system amenities comprising at least one other similar bollard and/or at least one site amenity (for example, seating, lighting, signage, a shelter, a trash can receptacle, and an ash urn). Where the site amenity system includes at least one site amenity, the site amenity is associated with the bollard, for example by being attached thereto.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIGS. 6A, 6B, and 5C are respectively perspective, side elevational, and top plan views of a grouping of bollards in accordance with the present invention.

FIGS. 9A, 9B, and 9C are respectively perspective, side elevational, and top plan views of a third embodiment of a single bollard having seating associated therewith.

FIGS. 22A, 22B, 22C, 22D, and 22E are respectively perspective, first, second, and third side elevational, and top plan views of a grouping of bollards having seating and a matching ash urn and trash can receptacle associated therewith.

DETAILED DESCRIPTION OF THE PREFERRED EMBODIMENTS

Figures 1A, 1B, 1C, 1D, 1F, 1G:
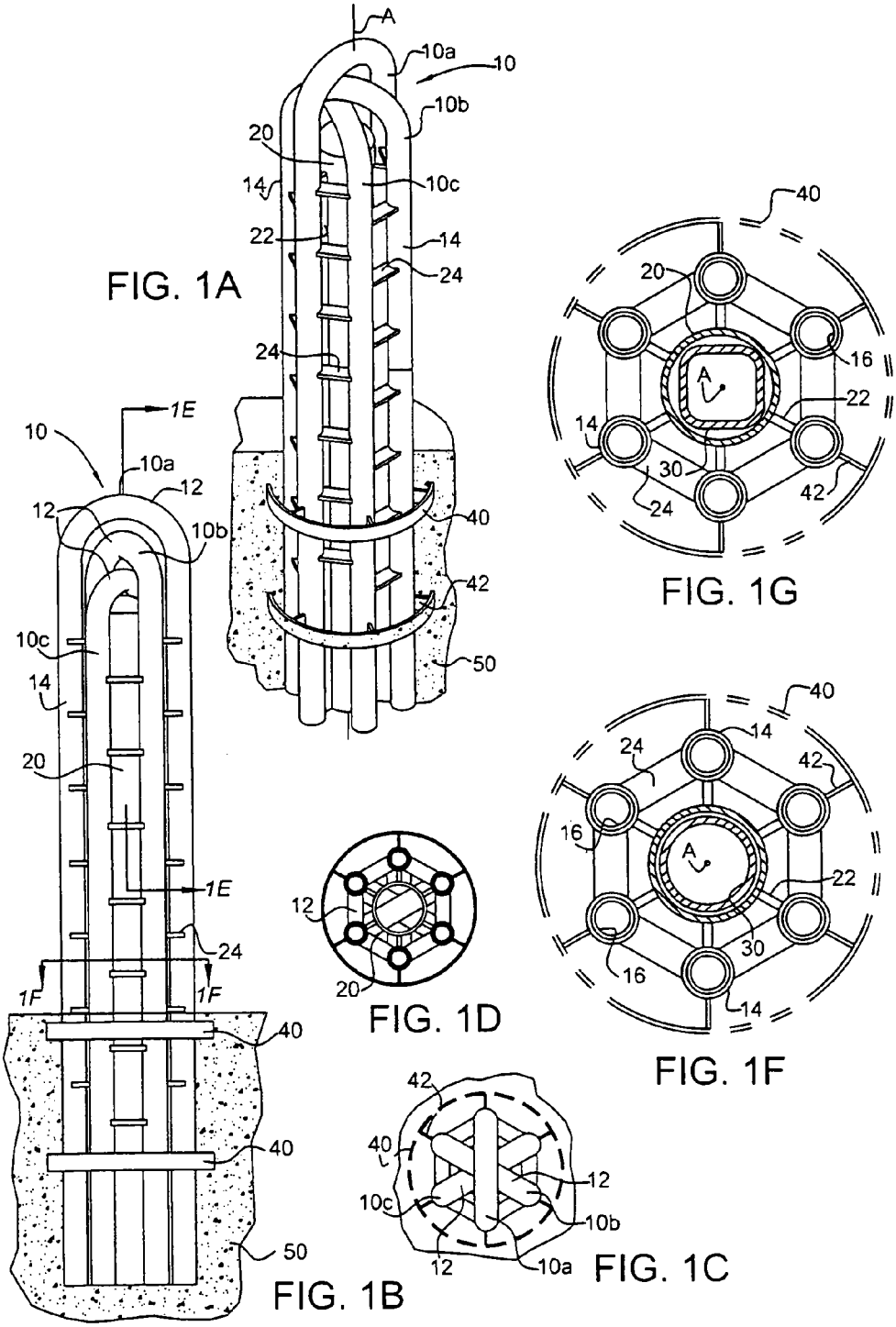
FIGS. 1A–1F are respectively perspective, side elevational, top and bottom plan, and vertical and horizontal cross-sectional views of a first embodiment of a bollard in accordance with the present invention.
FIG. 1G is a horizontal cross-sectional view of a first alternative center post of the bollard of FIGS. 1A–1F.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Referring to FIGS. 1A–1F, there is shown a first embodiment 10 of a bollard. The bollard 10 comprises a plurality of parallel, vertical legs 14 equally spaced apart from each other on the perimeter of a regular geometric shape, such as a circle or rectangle, with the legs being spaced around a vertical axis passing through the center of the regular geometric shape. The minimum number and/or cross-section of the legs 14 is governed by the need to avoid creating an entrapment area. As the width or diameter of the geometric shape increases, the number and/or cross-section of the legs 14 has to increase to keep the spacing between adjacent legs 14 small enough to avoid creating an entrapment area, for example, below 3½ inches.

The "footprint" of the bollard is governed by the transverse cross-sections, positions, and number of the legs 14. Making the distance between the vertical axis of each leg 14 and the vertical axis passing through the center of the geometric shape the same will yield a substantially circular footprint (as shown, for example, FIGS. 1A–1D, or this distance can be varied to yield a non-circular footprint.

Each leg 14 is tubular and can optionally be provided with a reinforcing insert 16. The reinforcing insert 16 can be a piece of tubing having the same cross-sectional shape as the leg 14, but having an outer perimeter slightly smaller than the inner perimeter of the leg 14 so as to be insertable in the leg 14.

Figure 1E:
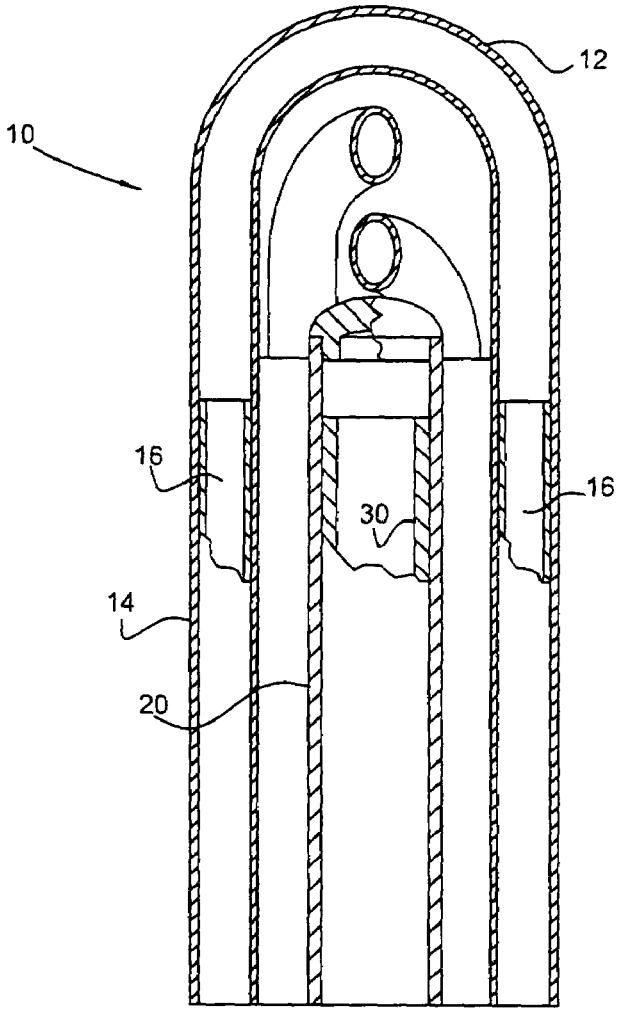
Figure 2A:
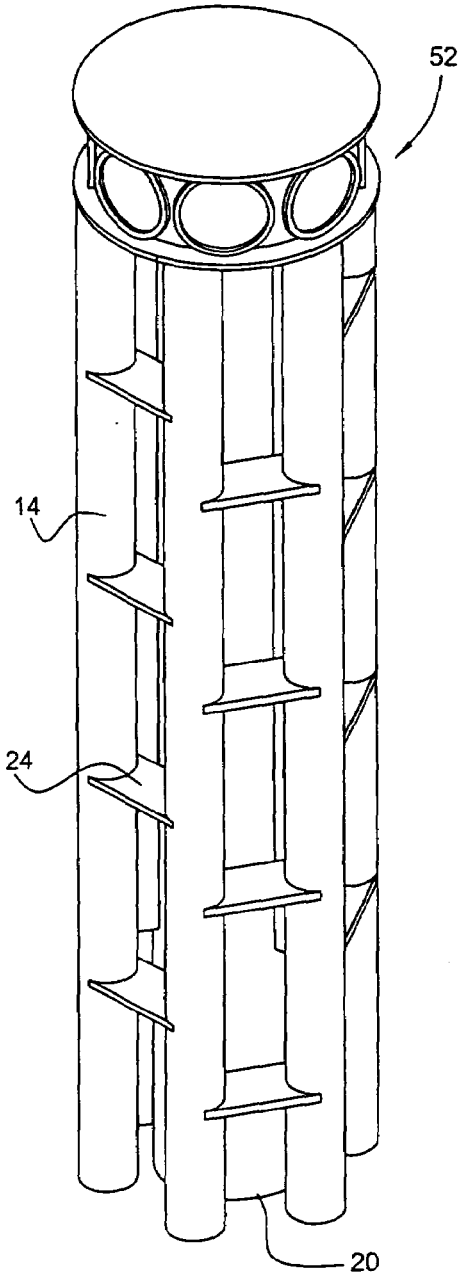
FIGS. 2A and 2B are respectively perspective and side elevational views of a second embodiment of a bollard in accordance with the present invention.
Figure 2B:
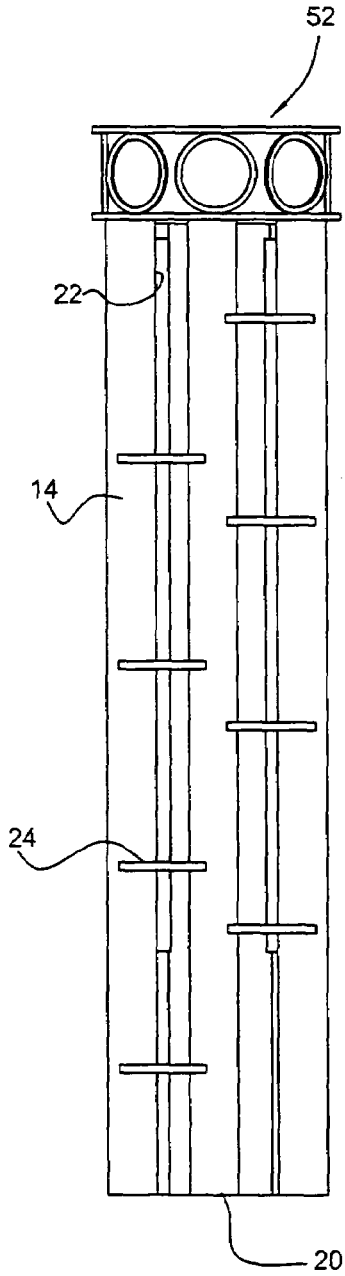
Figure 3A:
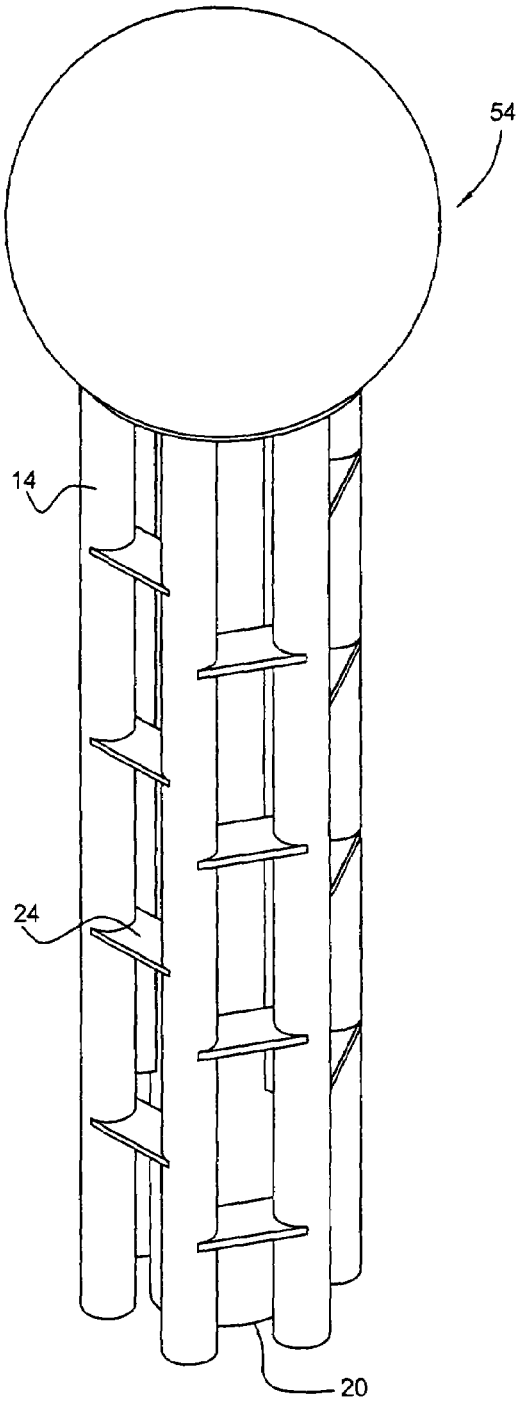
FIGS. 3A and 3B are respectively perspective and side elevational views of a third embodiment of a bollard in accordance with the present invention.
Figure 3B:
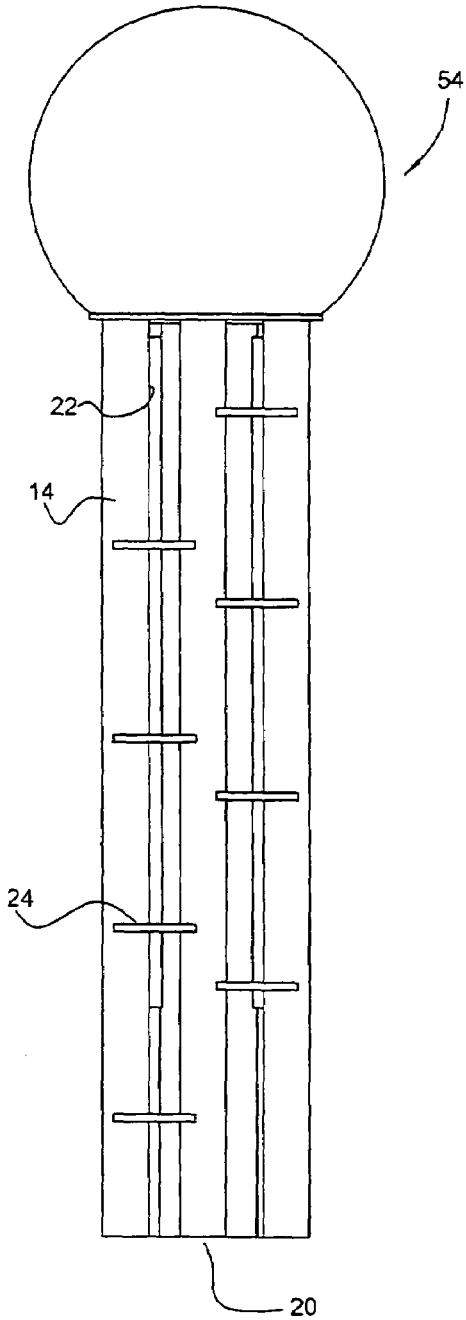
Figure 4A:
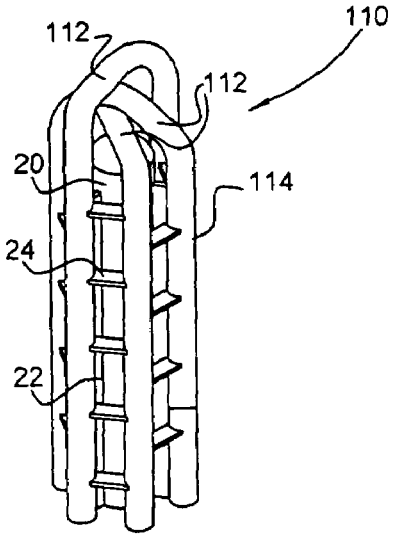
FIGS. 4A, 4B, 4C, and 4D are respectively first and second perspective and first and second side elevational views of a fourth embodiment of a bollard in accordance with the present invention.
Figure 4B:
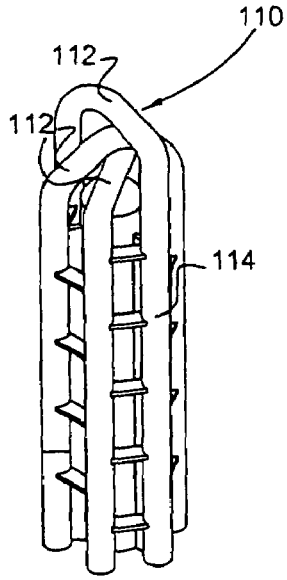
Figure 4C:
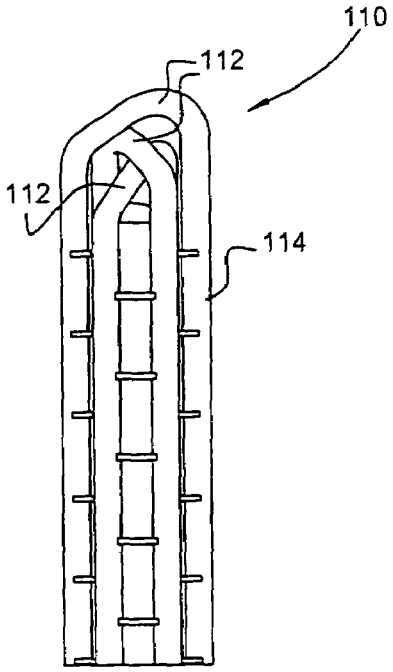
Figure 4D:
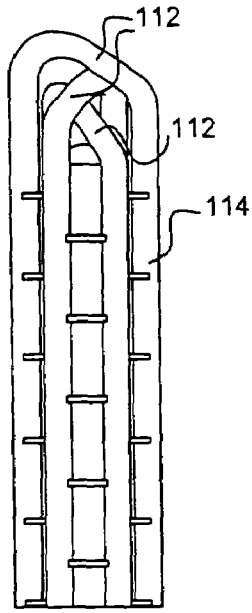
Figure 5A:
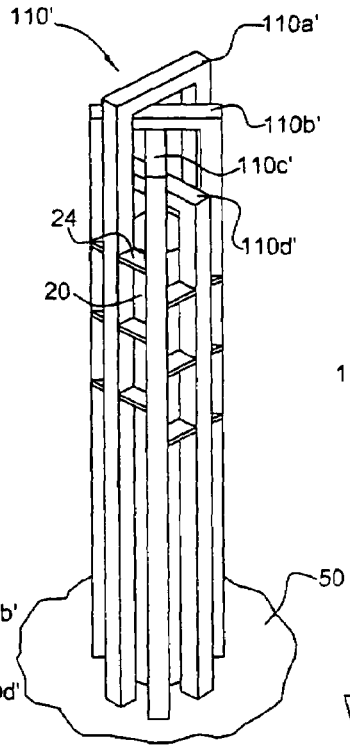
FIGS. 5A, 5B, 5C, and 5D are respectively perspective, first and second side elevational, and top plan views of a fifth embodiment of a bollard in accordance with the present invention.
Figure 5C:
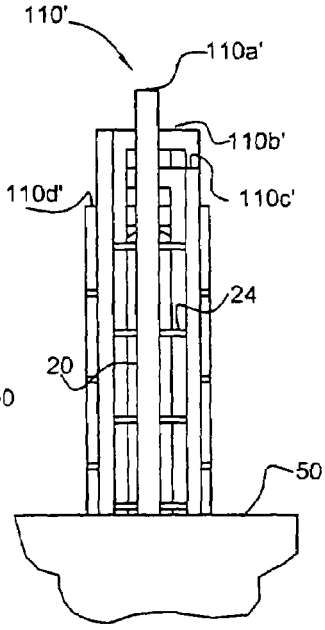
Figure 5B:
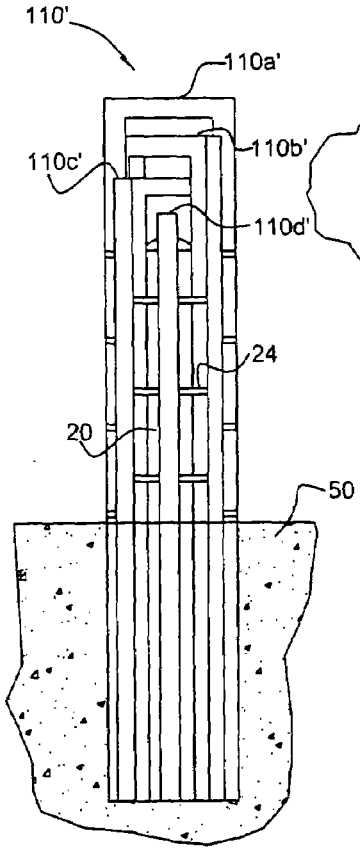
Figure 5D:
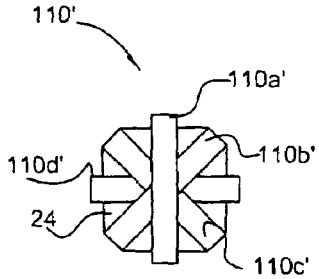

An even or odd number of legs 14 can be provided. If an even number is provided, as shown in FIGS. 1A–1F, the legs 14 can be arranged in diametrically opposite pairs of decreasing height, with the pairs of legs 14 optionally being joined at their tops by an upper transverse portion 12 to form a series of at least three nested, inverted substantially U-shaped forms 10*a*, 10*b*, and 10*c* of decreasing height set around a common vertical axis (which coincides with the axis passing through the regular geometric shape). The upper transverse portion can be curved, either symmetrically (as shown in FIGS. 1A, 1B, and 1E) or asymmetrically (as shown in FIGS. 4A–4D, wherein the bollard 110 has pairs of legs 114 connected by respective upper transverse portions 112), with a smooth transition to the legs, or it can be linear (as shown in FIGS. 5A–5D, wherein the bollard 110' has pairs of legs 114' connected by respective upper transverse portions 112') and joined to the legs at a miter joint. If no upper transverse portion 12 is provided, then the heights of the legs 14 can be determined by other design and/or esthetic criteria, the heights of the legs 14 need not be the same, and ornamentation 420 (including, but not limited to, cast ornamental tops for period styling, caps 52 (shown in FIGS. 2A and 2B,), globes 54 for lighting (shown in FIGS. 3A and 3B), etc.) can be provided at the top of the bollard 10.

As mentioned above, the widths of the U-shaped forms 10*a*, 10*b*, and 10*c* (that is, the distance between the outside edges of the legs 14) can either be the same for all forms, which will yield a substantially circular footprint (as shown, for example, FIGS. 1A–1E), or they can be varied to yield anon-circular footprint. For example, in a bollard 110 comprising four forms set around a common vertical axis to form an angle of 45° between adjacent forms, alternating forms can have widths in a ratio of $1:\sqrt{2}$, which will yield a square footprint (not shown).

The bollard further comprises means for joining the legs 14 together as a unit, for example, a tubular center post 20 having the vertical axis passing through the center of the regular geometric shape as its longitudinal axis and means for joining the tubular center post 20 to the legs 14. The means for joining the tubular center post 20 to the legs 14 can include, for example, webs 22 extending outwardly from the center post 20, oriented radially relative to the longitudinal axis of the center post 20, and joining each leg 14 to the center post 20, and a plurality of lateral crosspieces 24 joining adjacent legs 14. The radial webs 22 preferably are unitary in construction and extend in a vertical plane substantially the full height of the center post 20. However, it will be appreciated by those of skill in the art that other configurations are possible. The lateral crosspieces 24 preferably are plates extending in a horizontal plane, but alternatively can be plates extending in a vertical or angled plane, and can be at the same or alternating heights. Welding is used to join the radial webs 22 to the center post 20 and the legs 14 and to join the lateral crosspieces 24 to adjacent legs 14.

Figure 1H:
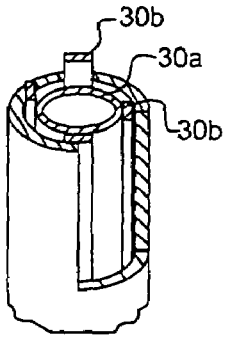
FIGS. 1H and 1I are partial perspective views, partially cut away, of a respective second and third alternative center post of the bollard of FIGS. 1A–1F.
Figure 1I:
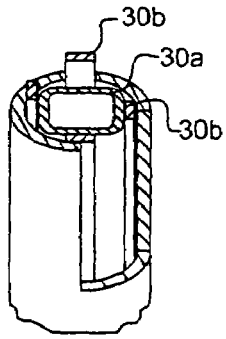

The tubular center post 20 preferably is cylindrical, with a circular cross-section, although other cross-sections, including square, can also be used. For additional reinforcement, the center post 20 optionally can be provided with a reinforcing insert 30 in much the same manner as the legs 14. The reinforcing insert 30 extends coaxially with and longitudinally through the center post 20, and can be in the form of tubing 30*a*, as shown in FIGS. 1F and 1G, tubing 30*a* with filler bars 30*b*, as shown in FIG. 1H, or an I-beam (not shown). The reinforcing insert 30 must have a cross-section that permits its insertion into the center post 20 while preventing any substantial lateral movement when inserted into the center post 20. As shown in FIGS. 1F and 1G, respectively, the insert 30 can have, for example, a circular or a square cross-section.

In the case where the reinforcing insert 30 includes tubing 3*a* with a circular cross-section, in one embodiment (shown in FIG. 1F), it has an outer perimeter just enough smaller than the inner perimeter of the center post 20 to be insertable in the center post 20, but large enough to be incapable of substantial lateral movement when inserted in the center post 20. In another embodiment (shown in FIG. 1H), the outer perimeter of the tubing 30*a* is smaller than the inner perimeter of the center post 20 to define a gap therebetween, and a plurality of filler bars 30*b* are inserted into the gap to prevent substantial lateral movement of the insert 30 as a whole (that is, tubing 30*a* and filler bars 30*b*).

In the case where the reinforcing insert 30 includes tubing 30*a* having a square cross-section, the corners of the square preferably are rounded. In one embodiment (shown in FIG. 1G), the outer diagonal of the tubing 30*a* is just enough smaller than the inner perimeter of the center post 20 so as to be insertable in the center post 20, but large enough to be incapable of substantial lateral movement when inserted in the center post 20. In another embodiment (shown in FIG. 11), the outer diagonal of the tubing 30*a* is smaller than the inner perimeter of the center post 20 to define a gap therebetween, and a plurality of filler bars 30*b* are inserted into the gap along the sides of the insert 30 to prevent substantial lateral movement of the insert 30 as a whole (that is, tubing 30*a* and filler bars 30*b*).

The legs 14 are not limited to tubing of circular cross-section, but can be made of tubing of other cross-sections including, but not limited to square or rectangular cross-sections. FIGS. 5A–5D show a fifth embodiment of a bollard 110' in which the forms 110*a*', 110*b*', 110*c*', and 110*d*' are made of tubing having a square cross-section. Each substantially U-shaped form has an upper transverse portion 112' (which in the embodiment of FIGS. 5A–5D is linear) and two parallel vertical legs 114', all of which are made of tubing having a square cross-section. In this configuration, the upper transverse portion 112' and the legs 114' can be fit together using miter joints that are welded together to provide a continuous structure. Preferably, the bollard 110' includes joining means as described above in connection with the embodiment of FIGS. 1A–1F. Also, the upper transverse portions 112' can be omitted from the bollard 110'. Anchoring means also can be provided to anchor the legs 114' to a support, as discussed hereinafter.

Referring again to FIGS. 1A and 1B, the anchoring means can be rings 40 encircling the legs 14 and joined thereto by radially-extending braces 42. The anchoring means provide additional surface area for anchoring the bollard in a support, such as a concrete footing 50. However, it is possible to anchor the bottoms of the legs 14 in a support such as concrete footing 50 without the anchor rings 40.

Exemplary dimensions for various embodiments of a bollard in accordance with the present invention are provided in Table 1:

TABLE 1

| Bollard dimensions | Vehicle velocity 30 m.p.h. | 40 m.p.h. | 50 m.p.h. |
|---|---|---|---|
| Footprint diameter | 13 inches | 16 inches | 16 inches |
| Total height | 96 inches | 96 inches | 96 inches |
| Above-ground height | 54 inches | 58 inches | 58 inches |
| Separation between transverse portions of forms | 1½ inches | 1½ inches | 1½ inches |
| Anchor ring outer diameter | 18 inches | 20 inches | 20 inches |
| Anchor ring height | 2 inches | 2 inches | 2 inches |
| Anchor ring width | ¼ inch | ¼ inch | ¼ inch |
| Anchor brace height | 2 inches | 2 inches | 2 inches |
| Anchor brace width | ¼ inch | ¼ inch | ¼ inch |
| Lateral crosspiece height | ½ inch | ½ inch | ½ inch |
| Lateral crosspiece width-- in radial direction | 2 inches | 2 inches | 2 inches |
| Vertical spacing between lateral crosspieces | 9 inches | 9 inches | 9 inches |
| Radial web width in circumferential direction | 1¼ inches | 1½ inches | 1½ inches |
| Radial web width in radial direction | ½ inch | ½ inch | ½ inch |
| Radial web height | 81¾ inches | 81 inches | 81 inches |

The size and strength of the material used can have a significant effect on the behavior and strength of the finished bollard. For example, with no change in general appearance, using standard schedule 40 pipe will provide one set of characteristics, while using high-tensile-strength tubular steel of the same outer diameter will yield far different characteristics. Even a broad change in the stopping range, center of impact, etc., can be accommodated by adding or deleting some of the lateral crosspieces 24, changing the configuration of the reinforcing insert 30 in the tubular center post 20 (from one of the embodiments shown in FIGS. 1F-_ to another of the embodiments), or by thickening some or all of the components.

Other factors also will have a significant effect on the characteristics of the fixture, including but not limited to: changing the positioning of the joining means (for example, moving the lateral crosspieces 24 and/or the radial webs 22 up or down or changing the lateral crosspieces 24 from the same to alternating heights or vice versa), changing the cross-section of the tubing used to make the legs 14 or U-shaped forms 10*a*, 10*b*, and 10*c*, increasing the heights of the legs 14, changing the configuration of the joining means (for example, changing the length of the radial webs 22 or the shape of the center post 20), changing the number of elements in the joining means (for example, adding or decreasing the number of lateral crosspieces 22 between each pair of adjacent legs 14), and whether or not the legs 14 are arranged in opposed pairs joined at the top to define U-shaped forms. Filling the inside of the legs 14 with concrete or other filler materials, or including a reinforcing insert 16 in the legs 14, or omitting the reinforcing insert 30 in the center post 20 will yield other results. Using multiple bollards of different heights (in the case of a bollard comprised of substantially U-shaped forms, the height of each bollard being determined by the height of its tallest substantially U-shaped form) placed adjacent to each other as shown and described in connection with FIGS. 6A–6C will also result in different characteristics, as will joining or linking bollards together using seating sections shown and described in connection with FIGS. 7A–7C, 8A–8D, 9A–9C, 10A–10D, 11A–11D, 12A–12D, 13A–13D, 14A–14D, and 15A–15D, or a sign frame as shown and described in connection with FIGS. 23A–23D, or the canopy of a shelter as shown and described in connection with FIGS. 18A–18C, 19A–19C, and 20A–20B, as functional and structural elements. There are conflicting requirements for strength, rigidity, and ductility that must be addressed.

Assume, for example, that a car is deliberately or accidentally driven toward a facility in which a plurality of the bollards in accordance with the invention are arrayed in front thereof. Also assume, for example, that the strength of the anchoring means anchoring the bollards in the ground is sufficient to restrain the fastened portion of each bollard over a known and defined range. Such anchoring means include but are not limited to the anchoring rings as described above or another configuration of radially-extending assembly below ground.

When a vehicle strikes the outer perimeter of the vertical bollard either used by itself or as part of a larger assembly, it is intended that the bollard will initiate a reaction similar to the concept of the "crumple zone" in automobile design. The energy of the impact will deform the bollard significantly. The horizontal energy of the crash will be deflected in a series of distortions that are both vertical and horizontal, with most of the horizontal energy being deflected in the vertical legs 14. The steel will deform, stretch, and translate energy to the adjacent sections of the substantially U-shaped forms, the joining means, and any other elements attached to them.

The energy needed to tear, bend, or deform each element of the bollard can be defined by the grade, weight, and characteristics of the material used. In the absorption of energy, the bollard will deform such that enormous energy is absorbed in the translating of the horizontal vector of the collision into the vertical and horizontal distortion of the bollard elements into the bollard cross-section itself. The height of the legs 14, the relationship of the height of the arches (if any), the placement and number of the lateral crosspieces 24, the number of legs, the combination of bollards, etc., all provide enormous flexibility in a homogeneous design motif. Similarly, using other attached elements, including benches, increases the area and function of the "crumple zone" significantly, distributing energy over more space, material, linked bollards, etc.

Changing the height of the legs 14 and the number, type, and placement of the joining elements can provide design flexibility in matching sections of the bollard to the intended use.

Figure 6A:
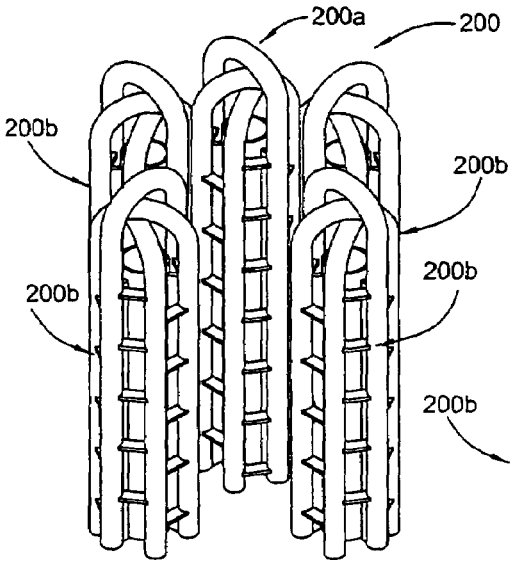
Figure 6B:
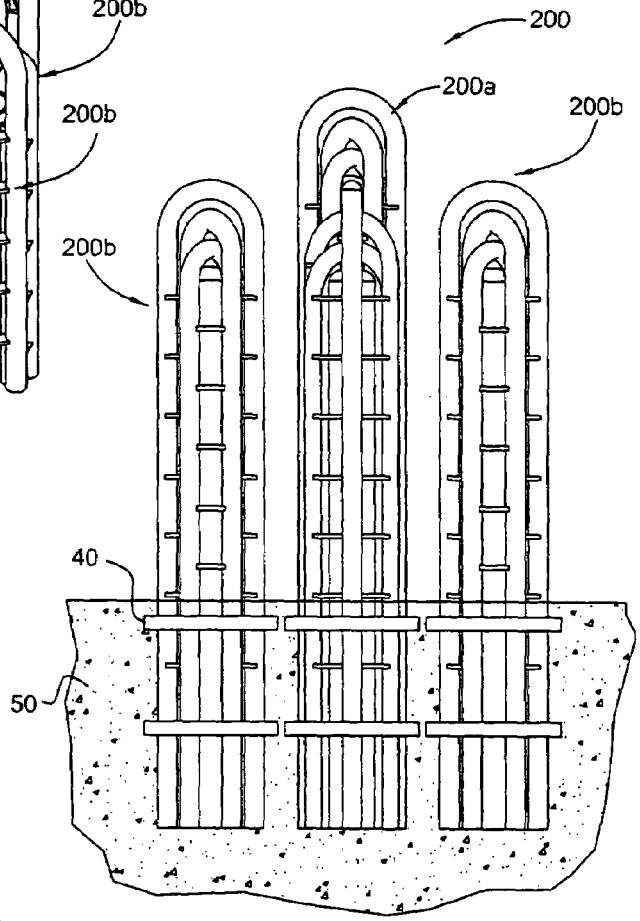
Figure 6C:
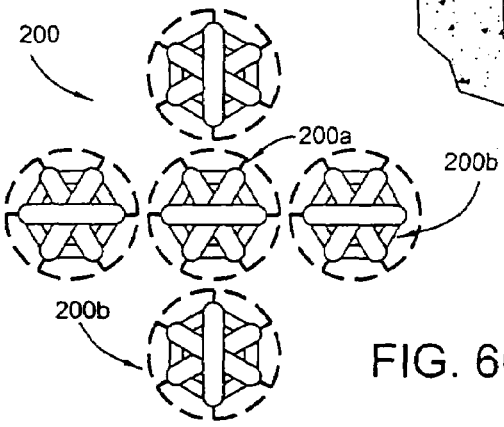

Examples of applications of the bollard in accordance with the present invention to site amenity systems or assemblies are shown and described in connection with FIGS. 6A–6C, 7A–7C, 8A–8C, 9A–9C, 10A–10C, 11A–11D, 12A–12D, 13A–13D, 14A–14D, 15A–15D, 16A–16D, 17A–17D, 18A–18C, 19A–19C, 20A–20B, 21A–21B, 22A–22C, 13A–23D, 24A–24B, 25A–25B, 26A–26C, 27A–27C, 22A–22D, and 23A–23D, and include, but are not limited to barriers, seating, lighting, signage, shelters, and litter control. The bollard can be used in a system comprising one or more other bollards and/or site amenities (for example, seating, lighting, signage, shelters, trash can receptacles, and ash urns) that adds security to the usual functions of site amenities. For example, as shown in FIGS. 6A–6C, a plurality of bollards 10 in accordance with the invention can be placed in a grouping 200 for use as a barrier, with a bollard 10' of a first height at the center, and the other bollards 10 of a second, shorter height spaced circumferentially around the first, center bollard 10'. In the embodiment of FIGS. 6A–6C, four peripheral bollards 10 are equidistantly spaced around the center bollard 10'. However, it will be appreciated by those of ordinary skill in the art that the number of second, peripheral bollards 10, as well as their size and spacing, can be varied according to the intended use, available space, and esthetic considerations. It will also be appreciated by those of skill in the art that it is possible to vary the configuration of the bollards used in a grouping 200, for example by changing the number and/or cross-section of the legs, by changing the number and configuration or type of the joining means, and by changing the configuration or type of anchoring means, all as described above.

With minor changes in fastening hardware, one or more bollards in accordance with the present invention can be used as supports for installing seating, lighting, signage, shelters, etc., with secure and protected electrical connections (where needed), flexible spacing, etc. For example, seating can be installed around a single bollard 10 (FIGS. 7A–7C, 8A–8C, and 9A–9C) or around a grouping of two or more bollards 10 (FIGS. 10A–10D, 11A–11D, 12A–12D, 13A–13D, 14A–14D, 15A–15D, 22A–22E, and 23A–23D); lamps can be installed above or adjacent a bollard 10 (FIGS. 3A and 3B); signage can be supported by a single bollard 10 or between a pair of bollards 10 (FIGS. 23A–23D); a shelter can be supported by two or more bollards 10 (FIGS. 16A–16C, 17A–17C, and 18A–18B); and trash can receptacles and/or ash urns can be supported by a single bollard 10 (FIGS. 19A–19B, 20A–20B, and 21A–21C) or between a pair of bollards (not shown) or on separate bollards 10 in a system of at least one bollard and at least one site amenity (FIGS. 22A–22D). In some embodiments, the at least one site amenity will function to join or link together at least two bollards 10 to provide a site amenity system having different behavior and strength characteristics than a single bollard 10.

It will also be appreciated by those of skill in the art that it is possible to vary the configuration of the bollard combined with the site amenities, for example by changing the number and/or cross-section of the legs (as shown and described, for example, in connection with FIGS. 30A–30D and FIGS. 31A–31D), by changing the number and configuration or type of the joining means, and by changing the configuration or type of anchoring means.

Referring to FIGS. 8A–8C, 9A–9C, and 10A–10C, there are shown three embodiments in which a single bollard 10 has associated therewith seating fixtures in the form of fan-shaped benches 310. In the embodiment shown in FIGS. 8A–8C, the fan-shaped benches 310 are installed around the bollard 10, supported by pedestals 312 set into a support surface radially outwardly from the bollard 10. In the embodiments shown in FIGS. 9A–9C and 10A–11C, the fan-shaped benches 310 are attached to the bollard 10 by different styles of brackets 314 and 314'. The crosspieces 24 of the bollard 10 can be drilled and tapped to permit attachment of the brackets 314 thereto. It will be appreciated by those of skill in the art that either multiple seating fixtures or a single, continuous seating fixture can be associated with the bollard 10, that the seating fixture can be solid, slatted, latticed, and other styles; that the style of brackets and pedestals used to support the seating fixtures are not limited to those illustrated, but can be selected from any other style suitable to the intended use; and that the brackets can be attached to the bollard 10 in a variety of ways.

Referring to FIGS. 11A–11D, 12A–12D, 13A–13D, 14A–14D, 15A–15D, 16A–16D, and 17A–17D, there are shown seven embodiments in which groupings of at least two bollards 10 have at least one seating fixture associated therewith. FIGS. 11A–11D, 12A–12D, and 13A–13D show embodiments in which the bollards 10 are arranged in a line. In the embodiment shown in FIGS. 11A–11D, two bollards 10 are spaced apart, and brackets 314 attached to the bollards 10 support an elliptical bench 330, the vertical axes of the bollards 10 being positioned approximately at the foci of the ellipse. The embodiment of FIGS. 12A–12D is similar to the embodiment of FIGS. 11A–11D, except that three, rather than two bollards 10 are provided. The embodiment of FIGS. 13A–13D is similar to the embodiment of FIGS. 11A–11D, except that the curved portions of the bench 330 and their supporting brackets 314 are omitted, so that the seating fixture comprises two separate rectangular benches 340, between which the two bollards 10 are sandwiched.

FIGS. 14A–14D and 15A–15D show embodiments in which three bollards 10 are arranged in a triangle. In the embodiment shown in FIGS. 14A–14D, brackets 314 attached to the bollards 10 support a separate rectangular bench 350 on each side of the triangle. In FIGS. 15A–15D, brackets 314 attached to the bollards 10 support a triangular bench 360 around the bollards 10.

In FIGS. 16A–16D, four fan-shaped benches 310 are associated (by attachment with brackets 314) with the exterior bollards 10 in a grouping 200 of five bollards 10 arranged as described in connection with FIGS. 6A–6C. The embodiment of FIGS. 17A–17D is similar to the embodiment of FIGS. 16A–16D, except that the bollards 100 are more closely spaced to each other.

It will be appreciated by those of skill in the art that the configuration of the seating fixtures and their supports can be varied in any manner suitable to their intended use, and taking into account esthetic considerations. For example, a pair of bollards 10 can be surrounded by an elliptical bench 330, as in the embodiment of FIGS. 11A–11D, sandwiched between a pair of rectangular benches 340, as in the embodiment of FIGS. 13A–13D, or can even be associated with a single bench 340 between them; and more than two bollards 10 can be arranged in a line between the seating fixtures, as shown in FIGS. 12A–12D.

Figure 7A:
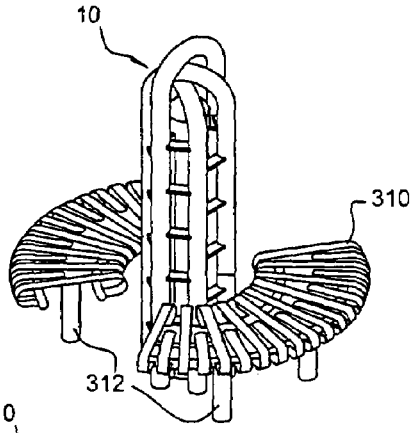
FIGS. 7A, 7B, and 7C are respectively perspective, side elevational, and top plan views of a first embodiment of a single bollard having seating associated therewith.
Figure 8A:
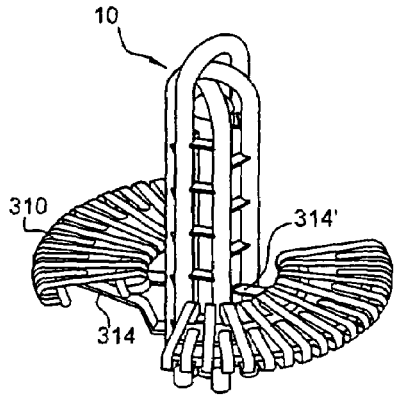
FIGS. 8A, 8B, and 9C are respectively perspective, side elevational, and top plan views of a second embodiment of a single bollard having seating associated therewith.
Figure 7B:
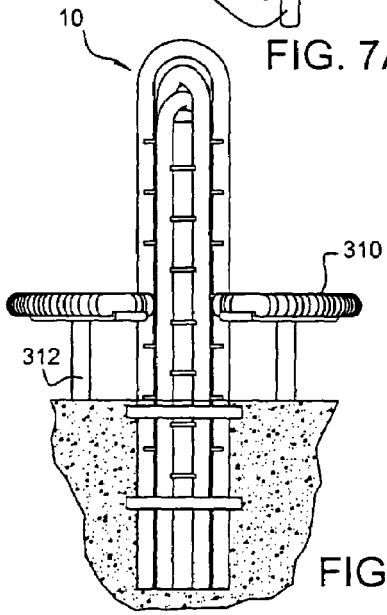
Figure 8B:
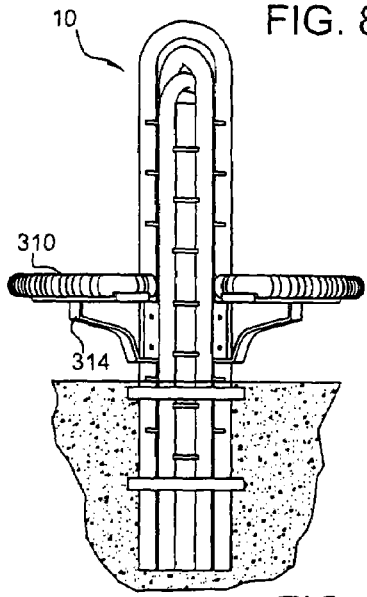
Figure 7C:
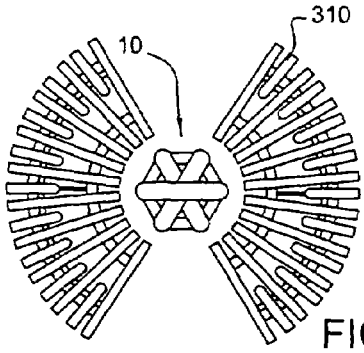
Figure 8C:
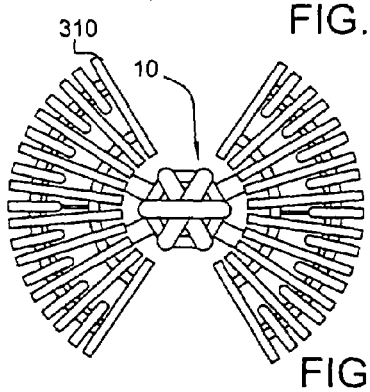
Figure 9A:
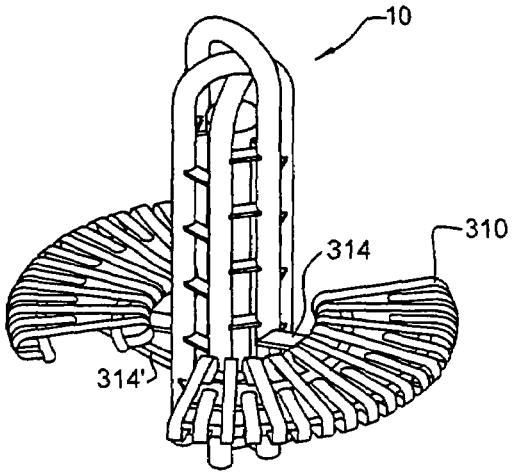
Figure 9B:
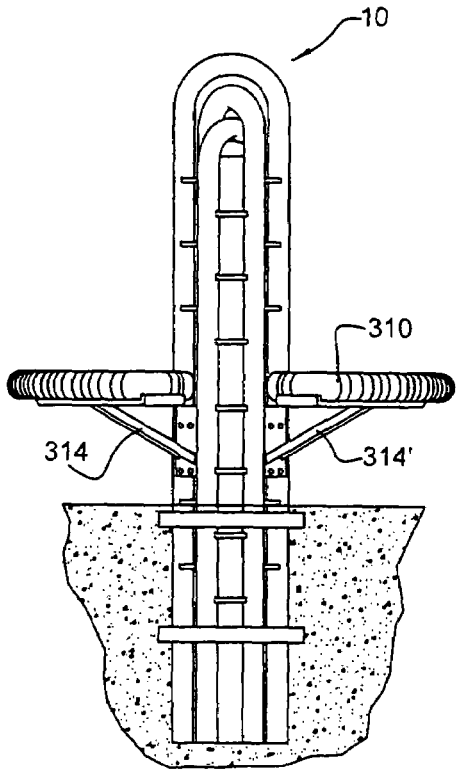
Figure 9C:
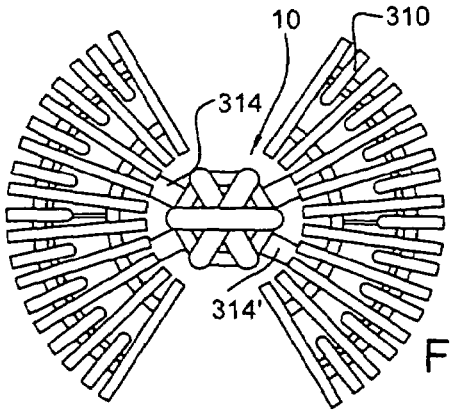
Figure 10A:
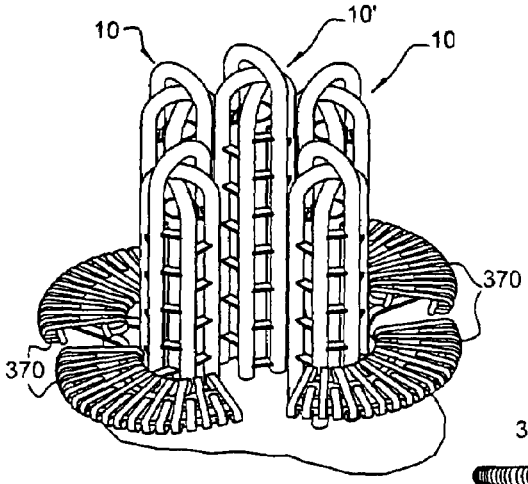
FIGS. 10A, 10B, 10C, and 10D are respectively perspective, first and second side elevational, and top plan views of a first grouping of bollards having seating associated therewith.
Figure 10B:
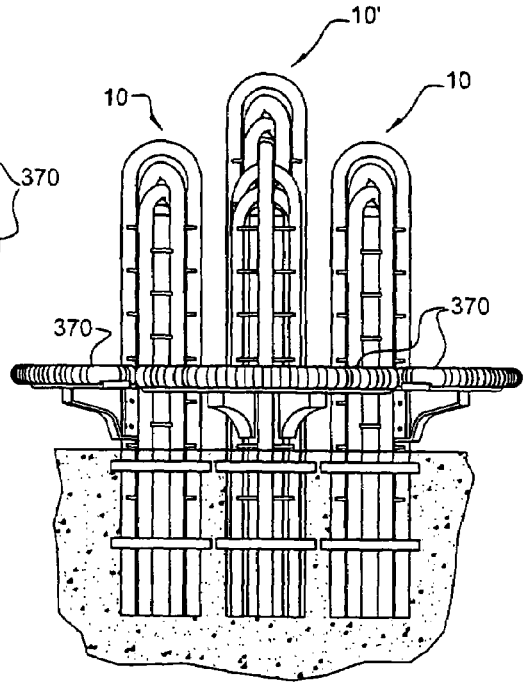
Figure 10D:
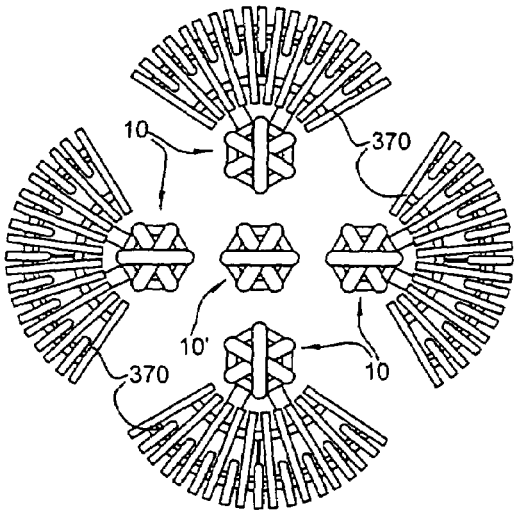
Figure 10C:
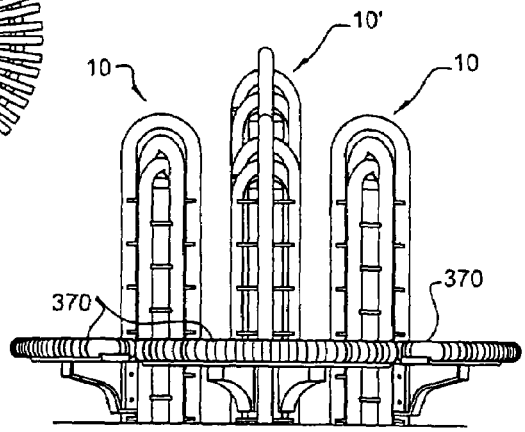
Figure 11A:
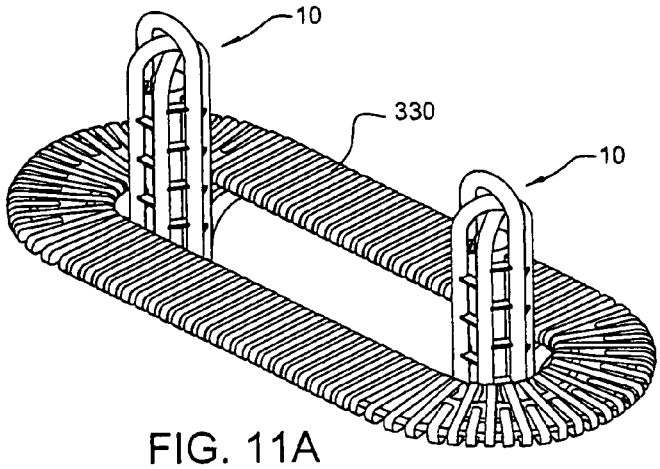
FIGS. 11A, 11B, 11C, and 11D are respectively perspective, first and second side elevational, and top plan views of a second embodiment of a grouping of bollards having seating associated therewith.
Figure 11B:
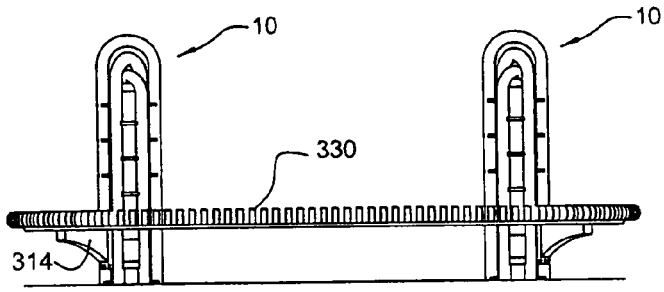
Figure 11C:
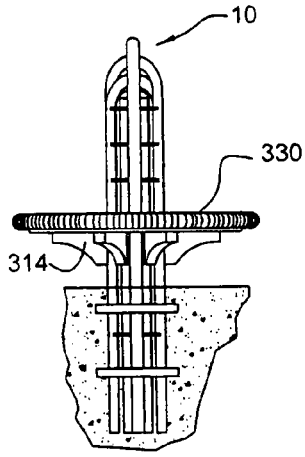
Figure 11D:
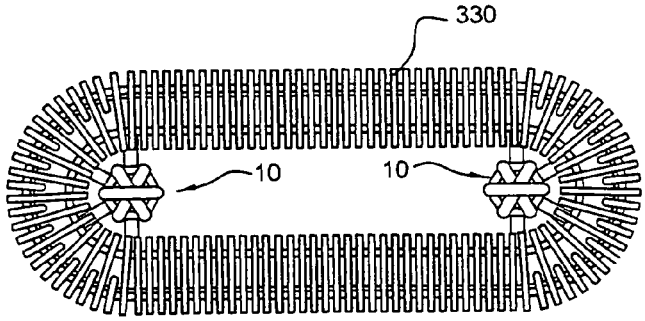
Figure 12A:
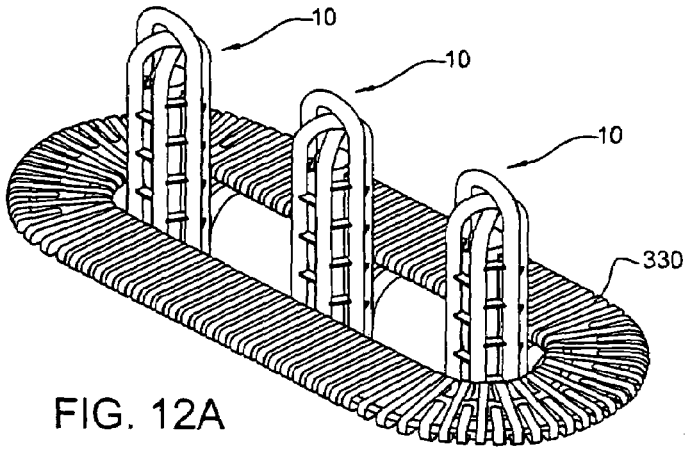
FIGS. 12A, 12B, 12C, and 12D are respectively perspective, first and second side elevational, and top plan views of a third embodiment of a grouping of bollards having seating associated therewith.
Figure 12B:
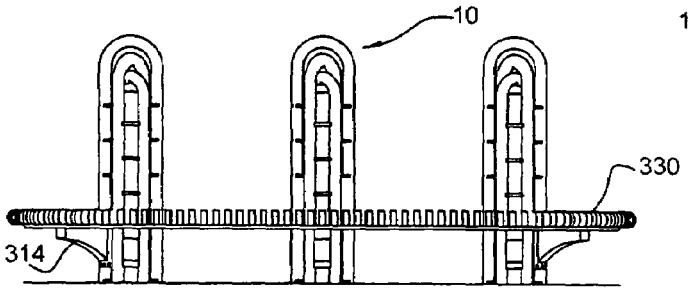
Figure 12C:
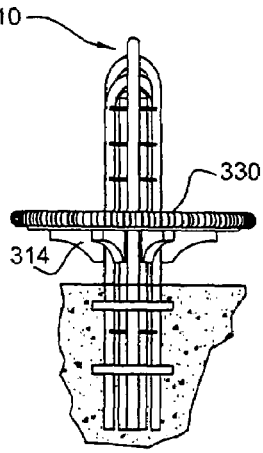
Figure 12D:
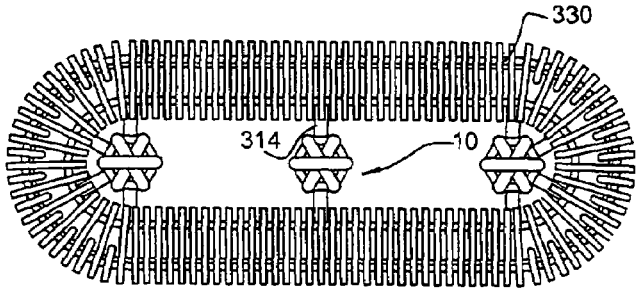
Figure 13A:
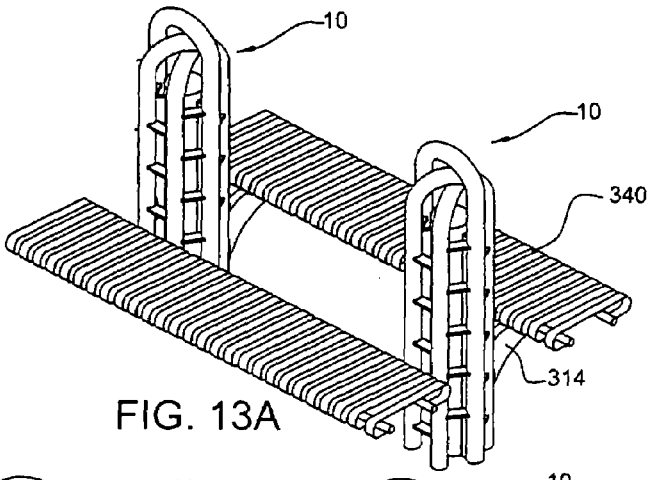
FIGS. 13A, 13B, 13C, and 13D are respectively perspective, first and second side elevational, and top plan views of a fourth embodiment of a grouping of bollards having seating associated therewith.
Figure 13B:
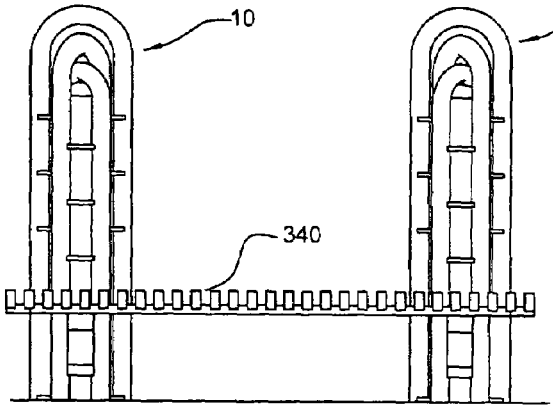
Figure 13C:
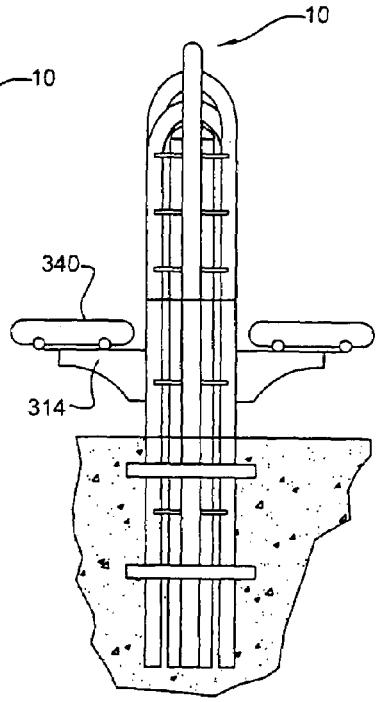
Figure 13D:
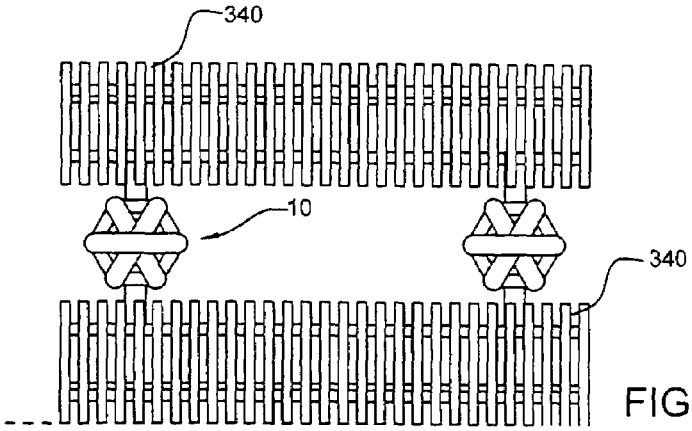
Figure 14A:
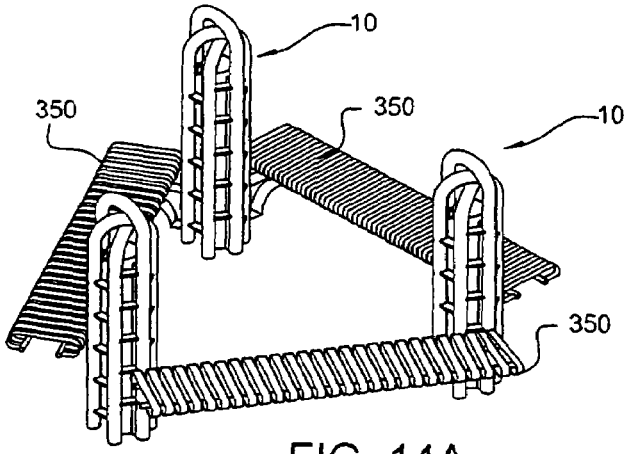
FIGS. 14A, 14B, 14C, and 14D are respectively perspective, first and second side elevational, and top plan views of a fifth embodiment of a grouping of bollards having seating associated therewith.
Figure 14B:
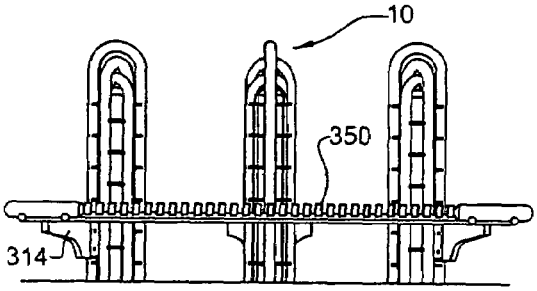
Figure 14C:
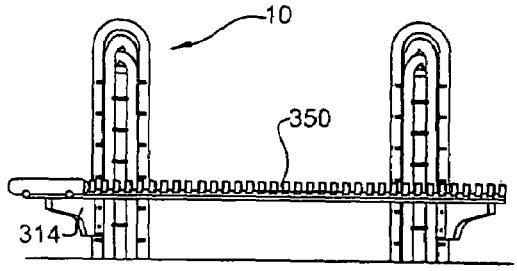
Figure 14D:
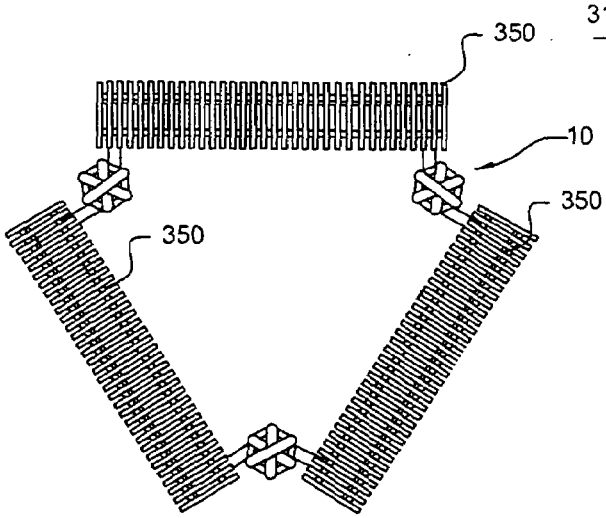
Figure 15A:
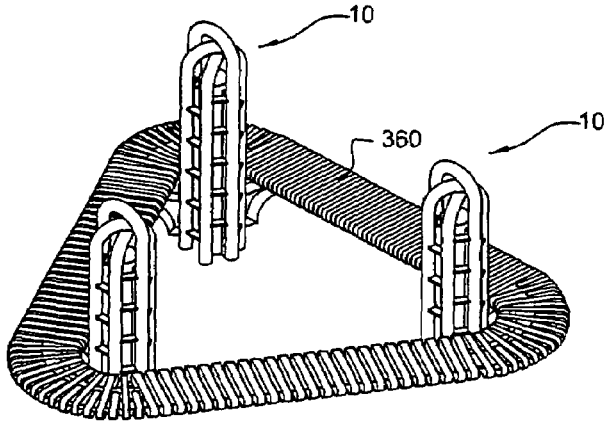
FIGS. 15A, 15B, 15C, and 15D are respectively perspective, first and second side elevational views of a sixth embodiment of a grouping of bollards having seating associated therewith.
Figure 15D:
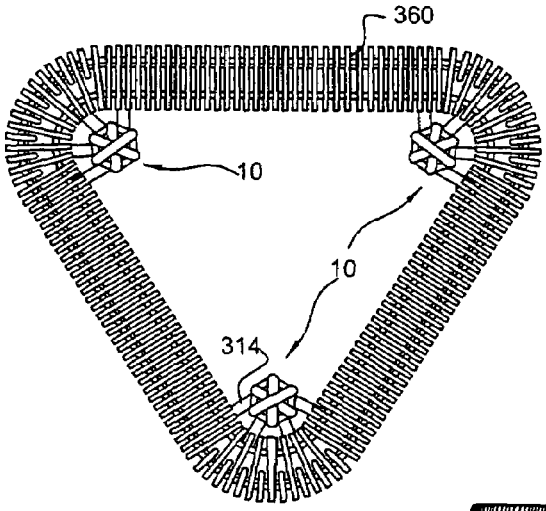
Figure 15B:
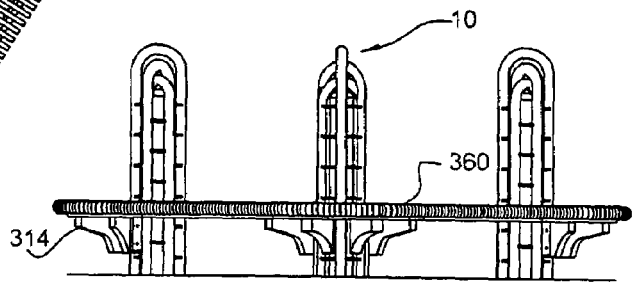
Figure 15C:
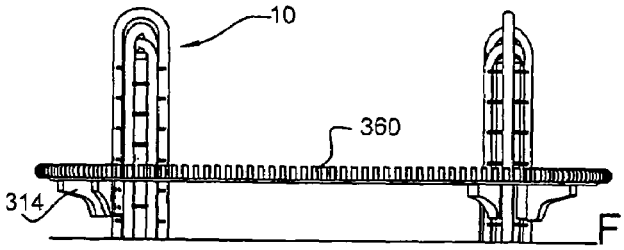

The embodiments of FIGS. 14A–14D and FIGS. 15A–15D can be modified for use with more than three bollards 10, with the bollards 10 being positioned at the vertices of a polygon, and the seating fixture or fixtures being configured accordingly, with a separate seating fixture (for example, a rectangular bench 340) on each side of the polygon or a polygonal bench extending around the bollards 10. Similarly, the embodiment of FIGS. 10A–10D can be modified for use with two, three, or more than four bollards 10, with the shape of the fan-shaped benches 310 being adjusted in accordance with the spacing of the bollards 10; and can also be modified by adjusting the spacing between the bollards 10. Also, the seating fixtures can be attached to the bollards 10 by brackets of any suitable configuration, such as brackets 314 or 314' as shown in FIGS. 8A–8C, 9A–9C, 10A–10D, 11A–11D, 12A–12D, 13A–13D, 14A–14D, and 15A–15D; or can be supported on pedestals, such as pedestals 312 as shown in FIGS. 7A–7C, in close proximity to the bollards 10.

Figure 16A:
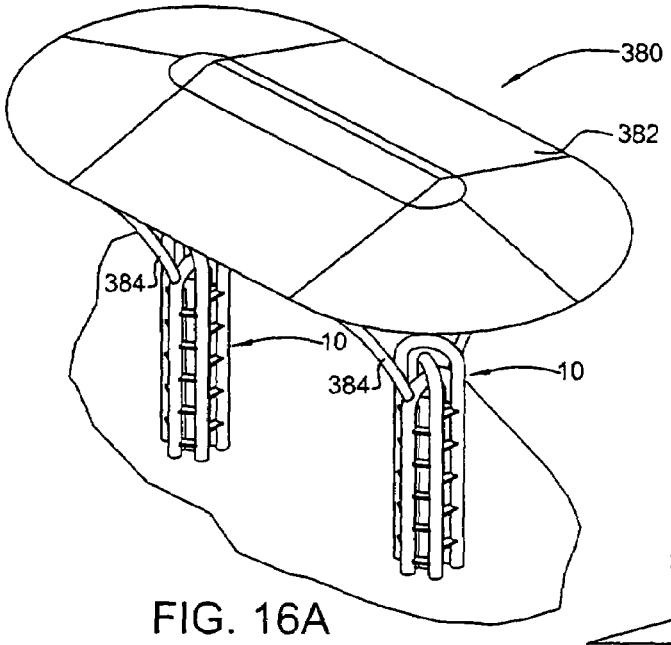
FIGS. 16A–16C are respectively perspective and first and second side elevational views of a first embodiment of a grouping of bollards having a shelter associated therewith.
Figure 16B:
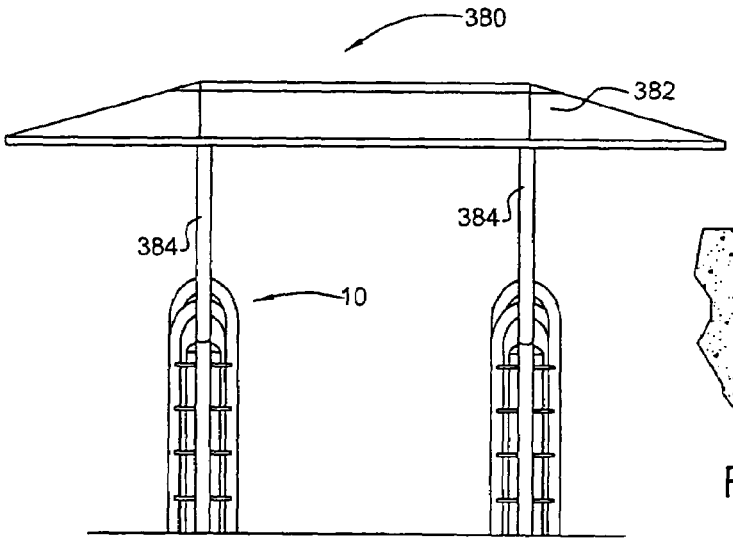
Figure 16C:
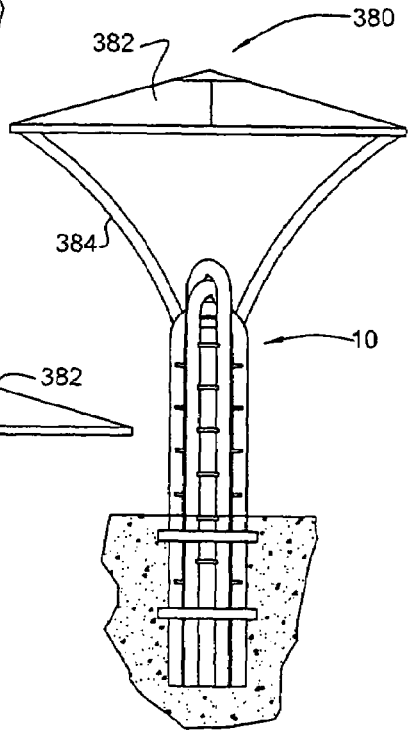
Figure 17A:
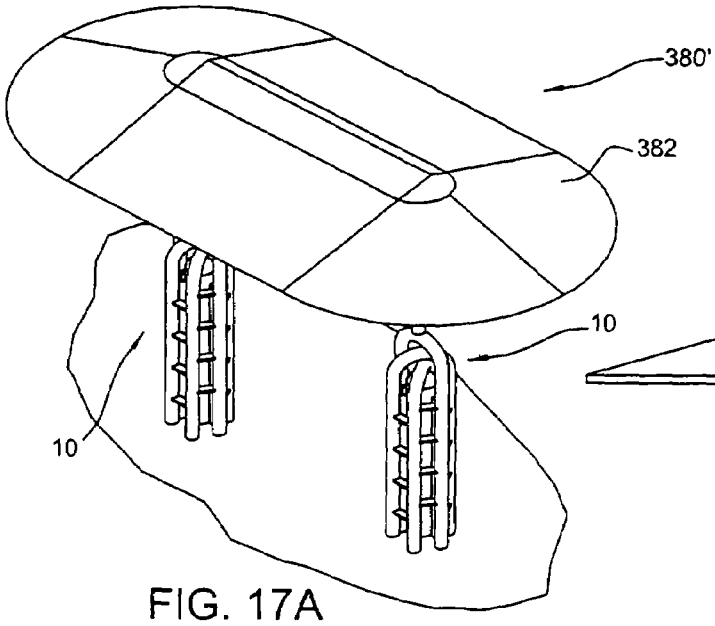
FIGS. 17A, 17B, and 17C are respectively perspective, front elevational, and side elevational views of a second embodiment of a grouping of bollards having a shelter associated therewith.
Figure 17C:
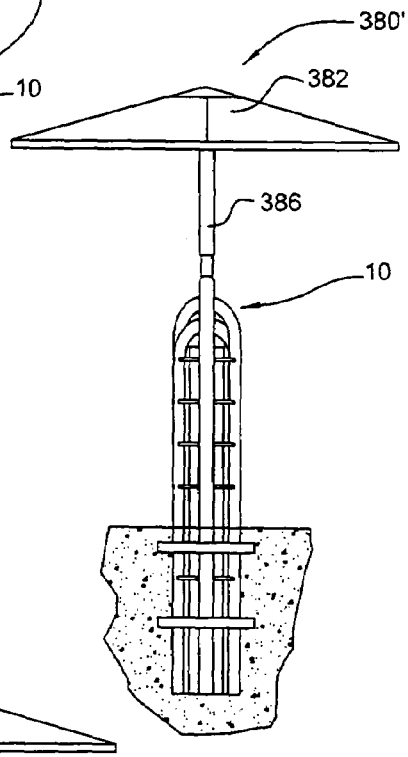
Figure 17B:
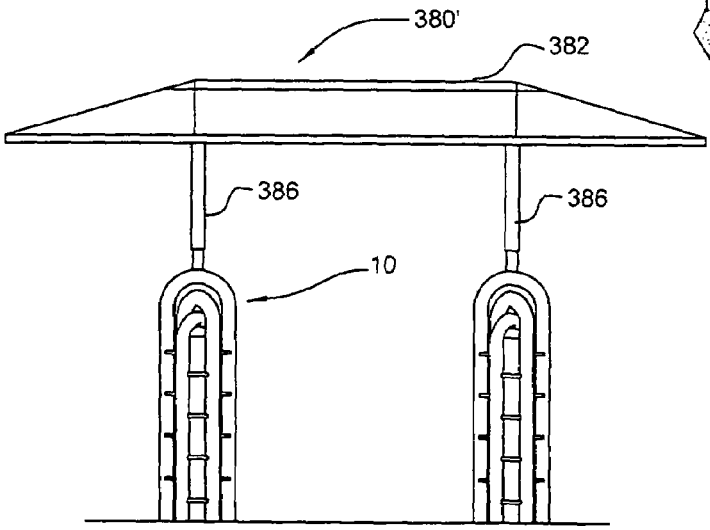
Figure 18A:
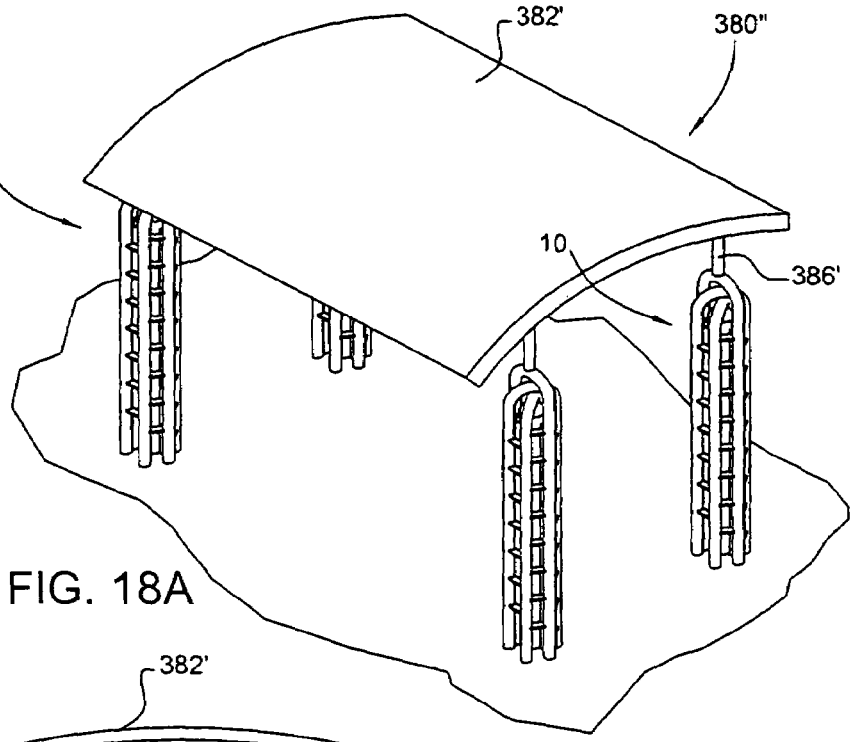
FIGS. 18A and 18B are respectively perspective and side elevational views of a grouping of a third embodiment of a grouping of bollards having a shelter associated therewith.
Figure 18B:
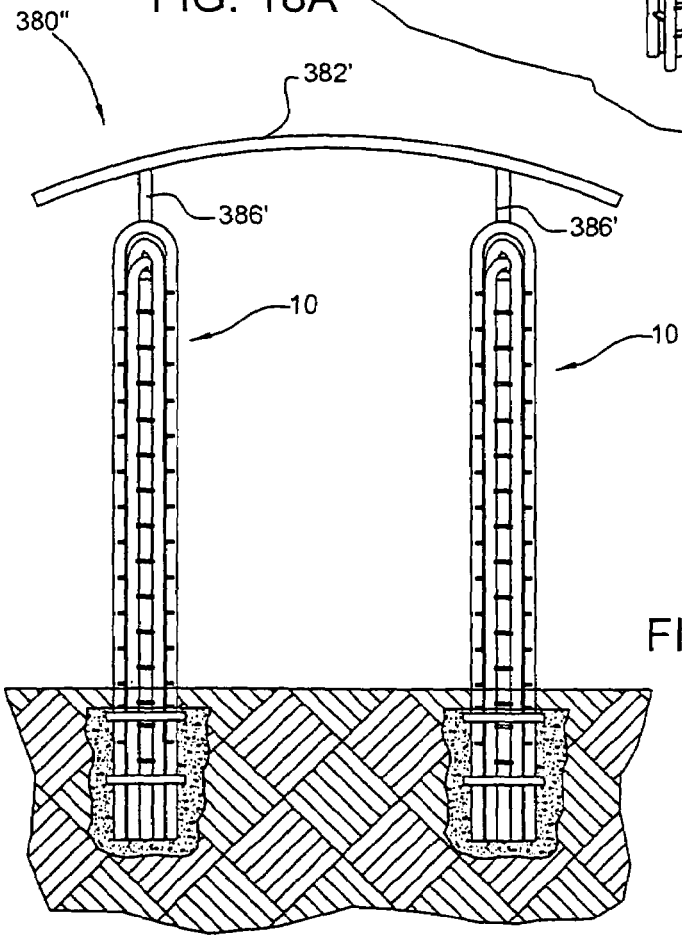

Referring to FIGS. 16A–16C, 17A–17C, and 18A–18B, there are shown three embodiments 380, 380', and 380" of shelters in which a canopy is supported by multiple bollards 10. In the embodiment of FIGS. 16A–16B, the shelter 380 comprises a pair of bollards 10, a canopy 382 above and spaced from the bollards 10, and a pair of brackets 384 extending outwardly from opposite sides of the upper transverse portion 12 of on one of the forms 10*a*, 10*b*, and 10*c*, in this case shortest of the forms, 10*c*. Alternatively, the canopy 382 can be supported by center poles 386 extending upwardly from the uppermost upper transverse portion 12 of each bollard 10, as shown in FIGS. 17A–17C. In the embodiment of FIGS. 18A–18B, the shelter 380" comprises a canopy 382' supported by four extending center poles 386' of four correspondingly arranged bollards 100.

It will be appreciated by those of skill in the art that the shape and size of the canopy can be varied according to the intended use and esthetic considerations. Such variations include, but are not limited to, a shape that is elliptical in outline, as shown in FIGS. 16A–16C and 17A–17C, a shape that is peaked, as also shown in FIGS. 16A–16C and 17A–17C, a shape that is rectangular in outline, as shown in FIGS. 18A–18B, and a shape that is bowed, as also shown in FIGS. 18A–18B. Similarly, the number of bollards 10 used to support the canopy can be varied, for example by arranging at least two in spaced linear fashion, as shown in FIGS. 16A–16C and 17A–17C, or by using multiple pairs as shown in FIGS. 18A–18B. As will be appreciated by those of skill in the art, the length of the shelter can be increased by increasing the number of bollards used to support the canopy. As also will be appreciated by those of skill in the art, the shelter can also include other site amenities, such as one or more fan-shaped benches 310 associated with each bollard 10 or 100', or at least one rectangular bench 340 or elliptical bench 330 associated with pairs of the bollards 10 or 100'.

Figure 19A:
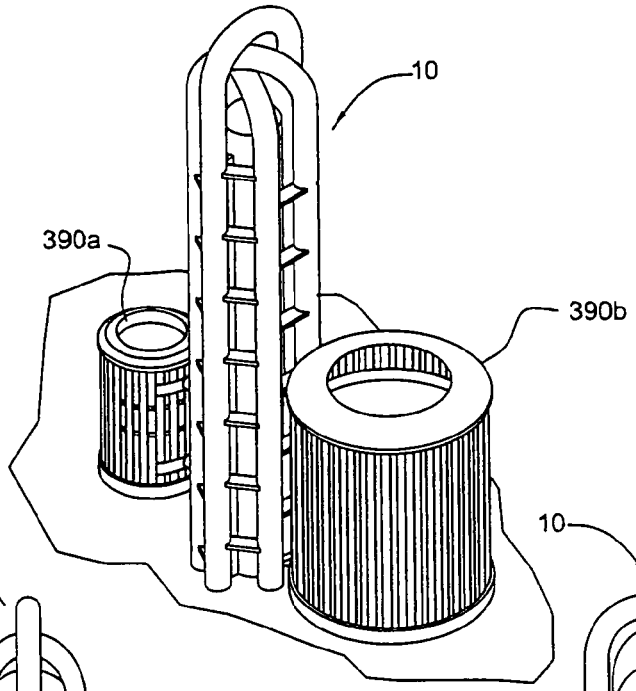
FIGS. 19A, 19B, and 19C are respectively perspective and first and second side elevational views of a bollard having a matching ash urn and trash can receptacle associated therewith.
Figure 19B:
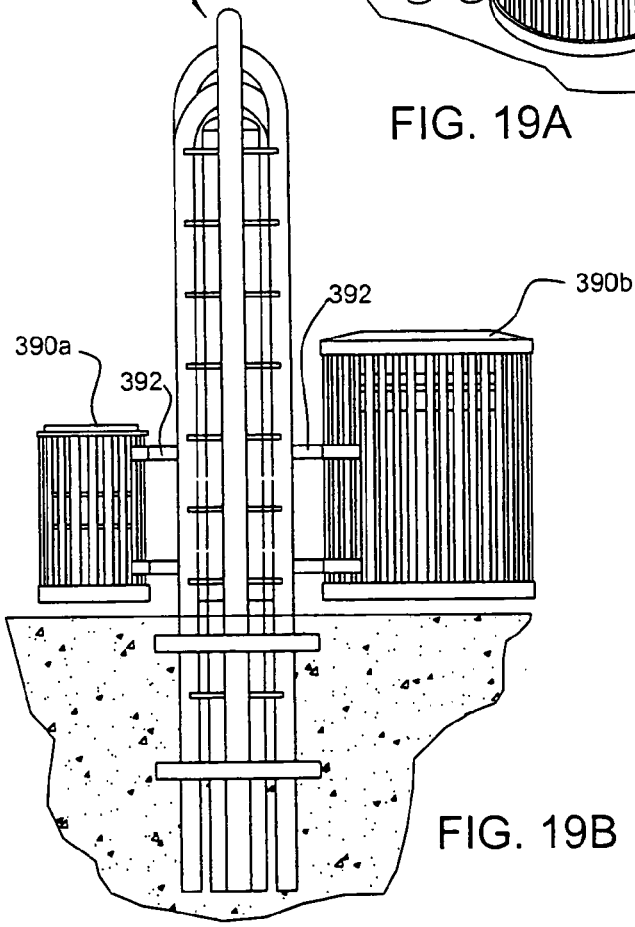
Figure 19C:
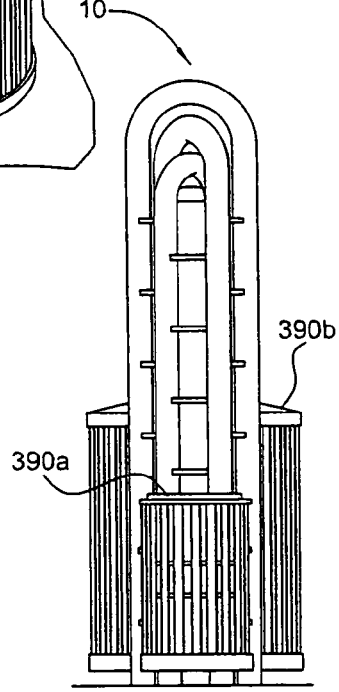

Referring to FIGS. 19A–19C, there is shown an ash urn 390*a* and matching trash can receptacle 390*b*, associated with a bollard 10. Brackets 392 are attached at one end between two adjacent legs 14 of the bollard 10 and at the other end to the sides of the ash urn 390*a* and trash can receptacle 390*b*. The crosspieces 24 of the bollards 10 can be drilled and tapped to permit attachment of the brackets 392 thereto.

Figure 20A:
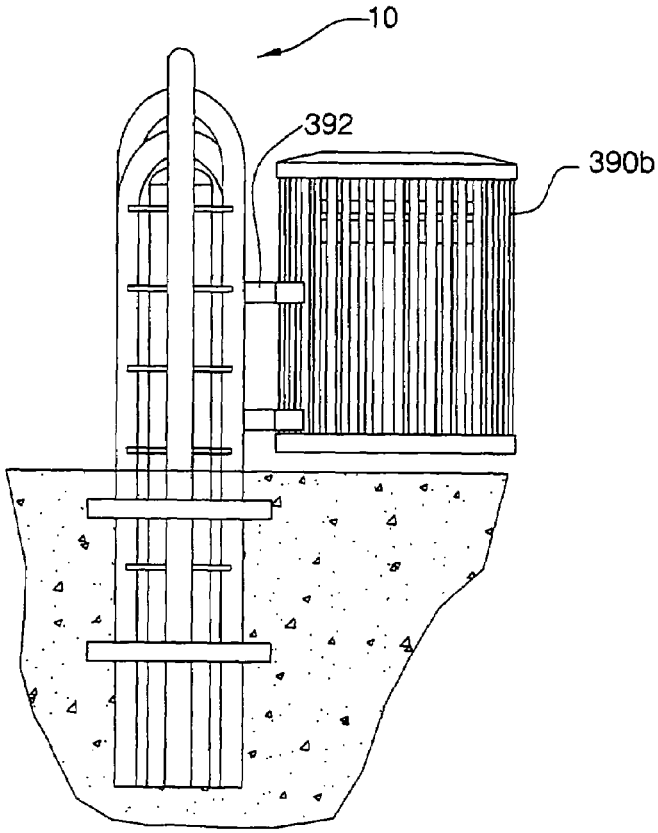
FIGS. 20A and 20B are respectively first and second side elevational views of a bollard having a trash can receptacle associated therewith.
Figure 20B:
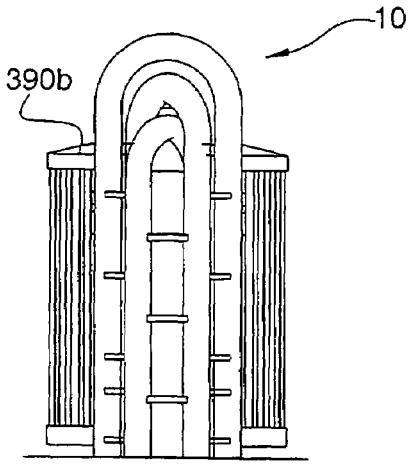
Figure 21A:
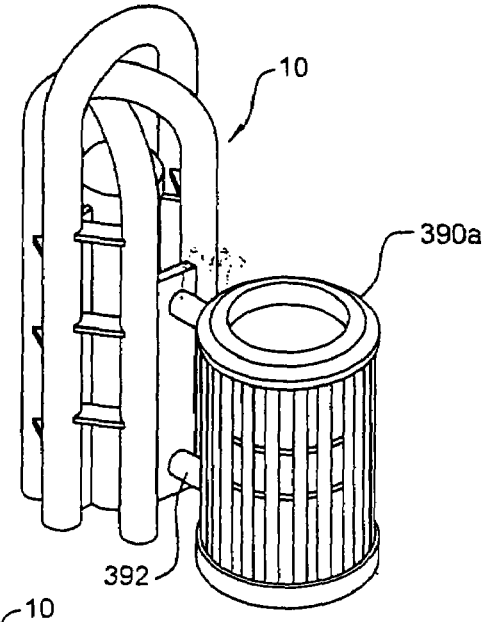
FIGS. 21A, 21B, and 21C are respectively perspective and first and second side elevational views of a bollard having an ash urn associated therewith.
Figure 21B:
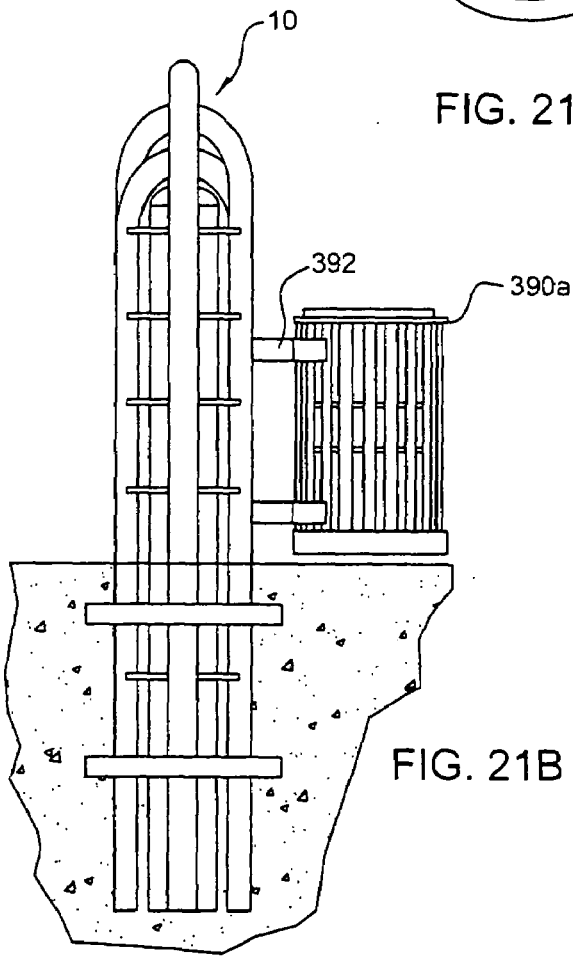
Figure 21C:
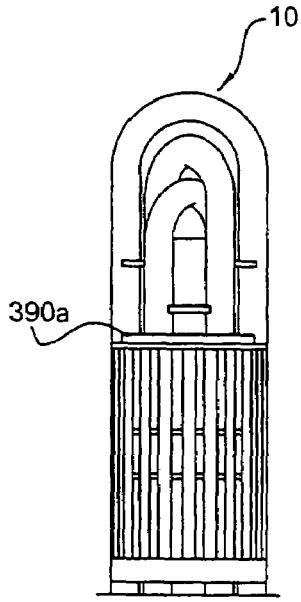
Figure 23A:
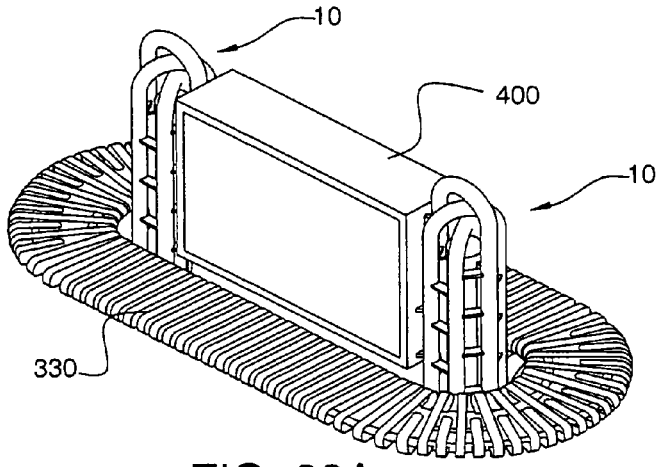
FIGS. 23A, 23B, 23C, and 23D are respectively perspective, first and second side elevational, and top plan views of a grouping of bollards having seating and signage associated therewith.
Figure 23B:
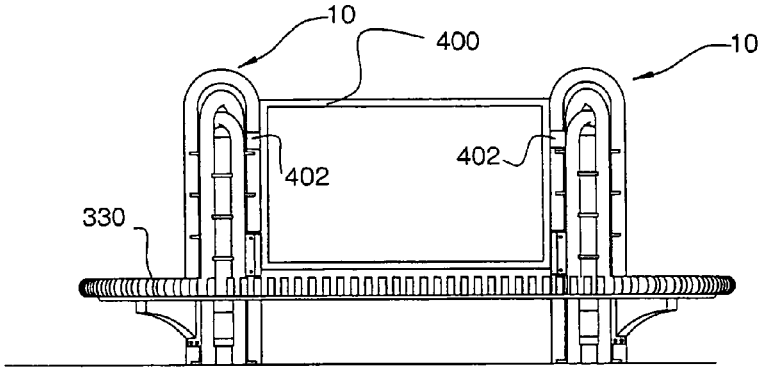
Figure 23C:
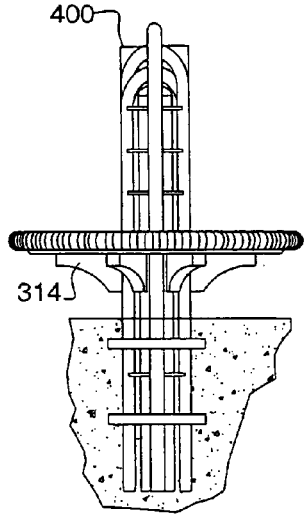
Figure 23D:
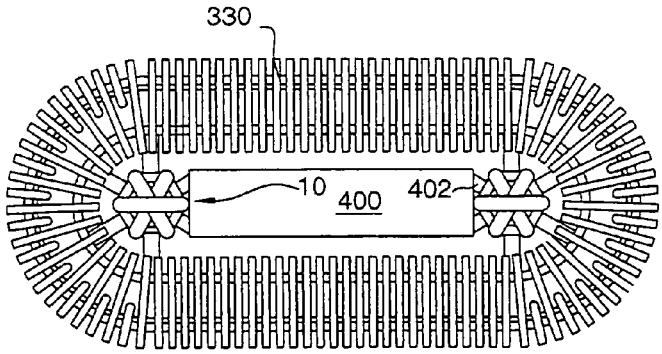

It will be appreciated by those of skill in the art that the ash urn 390*a* and trash can receptacle 390*b* can have a variety of configurations (examples of different configurations include, but are not limited to the designs of U.S. Pat. Nos. D304,253, D304,632, D314,461, D322,347, D322,348, D322,702, D353,250, D417,053, D441,932, D445,982, D450,166, D452,760, D454,238, D458,431, D460,591, D460,592, D460,593, D461,939, which are incorporated herein by reference in their entireties), they can be attached to the bollard 10 relative to different pairs of legs 14, and they can be associated singly with the bollard 10, as shown in FIGS. 20A–20B and 21A–21C, rather than together (that is, an ash urn 390*a* alone can be associated with the bollard 10, as shown in FIGS. 21A–21C, as can the trash can receptacle 390*b*, as shown in FIGS. 20A–20B).

It is contemplated that the bollard in accordance with the present invention can be combined with multiple types of site amenities, to provide a multi-function site amenity system. For example, two or more bollards can be used to support both seating and litter control amenities, such as the benches 310 and 340 and ash urn 390*a* and trash can receptacle 390*b* as shown in FIGS. 22A–22D; and two or more spaced bollards can be used to support both seating and signage amenities, such as the bench 330 and sign 400 as shown in the embodiment of FIGS. 23A–23D, which are respectively attached to the bollards 10 by brackets 314 and brackets 402.

It will also be appreciated by those of skill in the art that it is possible to vary the configuration of the bollard combined with the various seating fixtures and their supports, for example by changing the number and/or cross-section of substantially U-shaped forms (as shown and described, for example, in connection with FIGS. 30A–30D and FIGS. 31A–31D), by omitting the upper transverse portions 12 entirely, by changing the number and configuration or type of the joining means (as shown and described in connection with FIGS. 4A–4C), and by changing the configuration or type of anchoring means.

As can be appreciated from the foregoing, the esthetic requirement for site amenities in public spaces is well-served by the bollard in accordance with the invention, as opposed to conventional concrete or other protective fixtures. The system of the bollard and associated site amenities is also extremely cost effective in that for little more than the cost of the amenities themselves, the added element of security can be addressed. The bollard alone or the system of multiple bollards or one or more bollards in associate with other site amenities can be installed with relatively common and available materials and equipment at relatively low cost.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. A bollard comprising:

at least three vertical legs spaced apart from each other on the perimeter of a geometric shape around a vertical axis passing through the center of the geometric shape, each of the legs having a vertical axis parallel to the vertical axis of all of the other legs and to the vertical axis passing through the center of the geometric shape, at least one of the number and the cross-section of the legs being set so that the spacing between adjacent legs is too small to create an entrapment area between adjacent legs; and joining means for joining the legs together as a unit.

2. The bollard of claim 1, further comprising reinforcing inserts inserted in each leg.

3. The bollard of claim 1, wherein the legs are spaced apart from each other on the perimeter of a regular geometric shape.

4. The bollard of claim 1, further comprising anchoring means for anchoring the legs within a support.

5. The bollard of claim 1, further including ornamentation at the top thereof.

6. A site amenity system comprising a center bollard as claimed in claim 1 and a plurality of circumferential bollards as claimed in claim 1 arranged circumferentially around the center bollard.

7. The bollard of claim 1, wherein the legs and the joining means have physical characteristics such that on impact by a moving vehicle, including an automobile or a truck, the bollard will initiate a "crumple zone" type reaction.

8. The bollard of claim 7, wherein the legs and the joining means have physical characteristics such that the bollard meets governmental standards addressing the threats posed by vehicular traffic.

9. The bollard of claim 7, wherein the legs and the joining means further have physical characteristics such that the energy of the impact will deform the bollard significantly, with the horizontal energy of the impact being deflected in a series of distortions that are both vertical and horizontal, with most of the horizontal energy being deflected in the legs.

10. The bollard of claim 1, wherein the joining means comprises a center post having the common vertical axis of the legs as its longitudinal axis and means for joining the center post to the legs.

11. The bollard of claim 10, wherein the means for joining the tubular post to the legs comprise webs extending outwardly from the center post, oriented radially relative to the common vertical axis, and joining each leg to the center post.

12. The bollard of claim 10, wherein the center post is tubular and has a reinforcing insert inserted therein, and wherein the reinforcing insert extends coaxially with and longitudinally through the center post and has a cross-section that permits its insertion into the center post while preventing any substantial lateral movement in the reinforcing insert when inserted into the center post.

13. The bollard of claim 12, wherein the reinforcing insert includes tubing extending coaxially with and longitudinally through the center post.

14. The bollard of claim 13, wherein there is a gap between the outside perimeter of the tubing and the inside perimeter of the center post, and wherein the reinforcing insert further includes a plurality of filler bars inserted into the gap to prevent substantial lateral movement of the tubing and the filler bars in the center post.

15. The bollard of claim 10, further comprising means for joining adjacent legs to each other.

16. The bollard of claim 15 wherein the means for joining adjacent legs to each other comprise a plurality of lateral crosspieces joining adjacent legs.

17. The bollard of claim 16, wherein the lateral crosspieces are at the same height.

18. The bollard of claim 16, wherein the lateral crosspieces are at alternating heights.

19. A site amenity system comprising at least one bollard as claimed in claim 1 and at least one site amenity associated with the at least one bollard.

20. The system of claim 19, wherein the at least one site amenity comprises seating and means for attaching the seating to the at least one bollard.

21. The system of claim 19, wherein the at least one site amenity comprises signage and means for attaching the signage to the at least one bollard.

22. The system of claim 19, wherein the at least one site amenity comprises a canopy and means for attaching the canopy to the at least one bollard.

23. The system of claim 19, wherein the at least one site amenity comprises a trash can receptacle and means for attaching the trash can receptacle to the at least one bollard.

24. The system of claim 19, wherein the at least one site amenity comprises an ash urn and means for attaching the ash urn to the at least one bollard.

25. The system of claim 19, comprising at least two bollards as claimed in claim 1 linked together by the site amenity, whereby the system has different behavior and strength characteristics than a bollard alone.

26. The system of claim 19, wherein the bollard further includes ornamentation at the top thereof.

27. A bollard comprising:

a plurality of vertical legs spaced apart from each other on the perimeter of a geometric shape around and parallel to a vertical axis passing through the center of the geometric shape, at least one of the number and the cross-section of the legs being set so that the spacing between adjacent legs is too small to create an entrapment area between adjacent legs;

joining means for joining the legs together as a unit; and anchoring means for anchoring the legs within a support, wherein the anchoring means comprises at least one ring encircling the legs and a plurality of braces joining the at least one ring to the legs.

* * * * *